US006786207B2

(12) United States Patent
Kojima et al.

(10) Patent No.: US 6,786,207 B2
(45) Date of Patent: Sep. 7, 2004

(54) EVAPORATIVE FUEL EMISSION CONTROL SYSTEM

(75) Inventors: Susumu Kojima, Susono (JP); Hidefumi Aikawa, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/391,743

(22) Filed: Mar. 20, 2003

(65) Prior Publication Data

US 2003/0196645 A1 Oct. 23, 2003

(30) Foreign Application Priority Data

Apr. 17, 2002 (JP) ..... 2002-115337
Apr. 24, 2002 (JP) ..... 2002-121902

(51) Int. Cl.[7] ..... F02M 37/04
(52) U.S. Cl. ..... 123/516; 123/514
(58) Field of Search ..... 123/516, 514, 123/518, 519, 520, 521, 557

(56) References Cited

U.S. PATENT DOCUMENTS 4,175,527 A * 11/1979 Sanada et al. ..... 123/514
5,687,697 A * 11/1997 Ishikawa ..... 123/520
5,868,119 A * 2/1999 Endo et al. ..... 123/516
5,957,113 A 9/1999 Masaki et al.
6,174,351 B1 * 1/2001 McDowell et al. ..... 96/4
6,176,259 B1 * 1/2001 Harde et al. ..... 137/587
6,230,693 B1 * 5/2001 Meiller et al. ..... 123/519
2001/0052292 A1 12/2001 Ito

FOREIGN PATENT DOCUMENTS

| | | |
|---|---|---|
| EP | 1 124 053 A2 | 8/2001 |
| JP | A 62-279825 | 12/1987 |
| JP | A 63-270524 | 11/1988 |
| JP | A 4-290518 | 10/1992 |
| JP | A 6-147037 | 5/1994 |
| JP | A 10-274106 | 10/1998 |

* cited by examiner

*Primary Examiner*—Carl S. Miller
(74) *Attorney, Agent, or Firm*—Oliff & Berridge, PLC

(57) ABSTRACT

An evaporative fuel emission control system includes a canister that adsorbs fuel vapor generated in a fuel tank, a canister outgoing gas producing unit that causes a canister outgoing gas to flow out of the canister, a vapor condensing unit that condenses the canister outgoing gas to provide a processed gas containing a higher concentration of fuel vapor than that of the canister outgoing gas, and a processed gas passage through which the processed gas is fed to the fuel tank. A controller of this system is operable to restrict flow of the processed gas into the fuel tank when the fuel vapor concentration in the processed gas is lower than or is expected to be lower than a predetermined level.

24 Claims, 13 Drawing Sheets

EVAPORATIVE FUEL EMISSION CONTROL SYSTEM

INCORPORATION BY REFERENCE

The disclosures of Japanese Patent Applications No. 2002-115337 filed on Apr. 17, 2002 and No. 2002-121902 filed on Apr. 24, 2002, each including the specification, drawings and abstract, are incorporated herein by reference in their entireties.

BACKGROUND OF THE INVENTION

1. Field of the Invention

The invention relates to an evaporative fuel emission control system, and in particular to an evaporative fuel emission control system for processing fuel vapor generated in a fuel tank of an internal combustion engine, without releasing the fuel vapor to the atmosphere.

2. Description of Related Art

Conventionally, there is known an evaporative fuel emission control system including a canister for adsorbing fuel vapor generated in a fuel tank, as disclosed in, for example, Japanese laid-open Patent Publication No. 10-274106. The system disclosed in this publication includes a mechanism for purging fuel vapor adsorbed in a canister by utilizing flow of air, and a separation film for separating or isolating fuel vapor from the purge gas. The system further includes a condensing unit for condensing fuel vapor isolated by the separation film, and a return path through which the condensed fuel returns into the fuel tank. The evaporative fuel emission control system thus constructed is able to process evaporative fuel vapor generated in the fuel tank, within a closed system including the canister. Thus, the known system is able to effectively prevent release of fuel vapor into the atmosphere without requiring complicated control, such as correction of the fuel injection quantity of the engine.

The above-described known system, however, is not able to sufficiently condense fuel vapor only by means of the separation film. Therefore, the known system includes the condensing unit for further condensing and liquefying evaporative fuel gas produced as a result of condensation by the separation film. If the use of the separation film alone can provide a sufficiently high condensing capability, on the other hand, the system may be constructed such that the evaporative fuel gas produced through condensation by the separation film is caused to flow into the fuel tank as it is. With this arrangement that requires no condensing unit, the system can be simplified, and the cost of manufacture of the system can be reduced.

In the meantime, when no fuel vapor is purged from the canister, namely, when no purge gas flows through the system, gas containing no fuel vapor but mainly consisting of air may accumulate on the upstream side of the separation film. Therefore, even if the separation film exhibits excellent condensing capability, processed gas whose fuel concentration is not sufficiently increased may be produced on the downstream side of the separation film immediately after purge gas starts flowing through the system.

If the processed gas having such a low concentration of fuel flows directly into the fuel tank, air contained in the gas may not be sufficiently dissolved in the fuel. Then, the presence of undissolved air may cause problems, such as vapor lock of a fuel feed pump or introduction of bubbles into fuel to be injected into the engine.

It is also to be noted that in the known system as described above, the separation film needs to be maintained in an appropriate condition so as to process gas containing fuel vapor. Thus, it is desirable to immediately detect an abnormality in the separation film, so as to ensure the intended functions of the system.

SUMMARY OF THE INVENTION

It is therefore an object of the invention to provide an evaporative fuel emission control system that has a function of condensing fuel vapor by using a separation film(s), and is also able to prevent a large amount of air from flowing into a fuel tank immediately after start of flow of purge gas.

To accomplish the above object, there is provided according to a first aspect of the invention an evaporative fuel emission control system, which comprises (a) a canister that adsorbs fuel vapor generated in a fuel tank, (b) a canister outgoing gas producing unit that causes a canister outgoing gas to flow out of the canister, (c) a vapor condensing unit that condenses the canister outgoing gas to provide a processed gas containing a higher concentration of fuel vapor than that of the canister outgoing gas, (d) a processed gas passage through which the processed gas is fed to the fuel tank, and (e) a controller that restricts flow of the processed gas into the fuel tank when the fuel vapor concentration in the processed gas is lower than or is expected to be lower than a predetermined level.

In the control system constructed as described above, when the fuel concentration in the processed gas is lower than the predetermined level or is expected to be lower than the predetermined level, flow of the processed gas into the fuel tank is restricted. It is thus possible to avoid problems that would occur if processed gas having a low concentration of fuel vapor is collected in the fuel tank.

According to a second aspect of the invention, there is provided an evaporative fuel emission control system, which comprises (a) a canister that adsorbs fuel vapor generated in a fuel tank, (b) a canister outgoing gas producing unit that causes a canister outgoing gas to flow out of the canister, (c) a vapor condensing unit that condenses the canister outgoing gas to provide a processed gas containing a higher concentration of fuel vapor than that of the canister outgoing gas, (d) a processed gas passage through which the processed gas is fed to the fuel tank, (e) a bypass passage that allows communication of an upstream side of the vapor condensing unit with the fuel tank, (f) a switching valve having an open state in which the bypass passage communicates the upstream side of the vapor condensing unit with the fuel tank, and a closed state in which the bypass passage is shut off, and (g) a switching valve controller that controls the switching valve such that the switching valve is placed in the open state during stop of the canister outgoing gas producing unit, and is placed in the closed state during an operation of the canister outgoing gas producing unit.

In the control system as described above, fuel vapor in the fuel tank is guided to the upstream side of the vapor condensing unit through the bypass passage during stop of the canister outgoing gas producing unit. Thus, a portion of the system at the upstream side of the vapor condensing unit can be filled with evaporative fuel gas having a high fuel concentration even under a situation where no canister outgoing gas flows through the system. It is therefore possible to produce processed gas having a sufficiently high fuel concentration immediately after start of an operation of the system.

According to a third aspect of the invention, there is provided an evaporative fuel emission control system, which comprises (a) a canister that adsorbs fuel vapor generated in a fuel tank, (b) a canister outgoing gas producing unit that causes a canister outgoing gas to flow out of the canister, (c) a vapor condensing unit that condenses the canister outgoing gas to provide a processed gas containing a higher concentration of fuel vapor than that of the canister outgoing gas, (d) a processed gas passage through which the processed gas is fed to the fuel tank, and (e) a canister heater that heats the canister. With this arrangement, the canister is heated by the canister heater so that fuel vapor can be purged from the canister at an improved efficiency.

BRIEF DESCRIPTION OF THE DRAWINGS

The foregoing and/or further objects, features and advantages of the invention will become more apparent from the following description of exemplary embodiments with reference to the accompanying drawings, in which like numerals are used to represent like elements and wherein.

DETAILED DESCRIPTION OF EXEMPLARY EMBODIMENTS

First Embodiment

Figure 1:
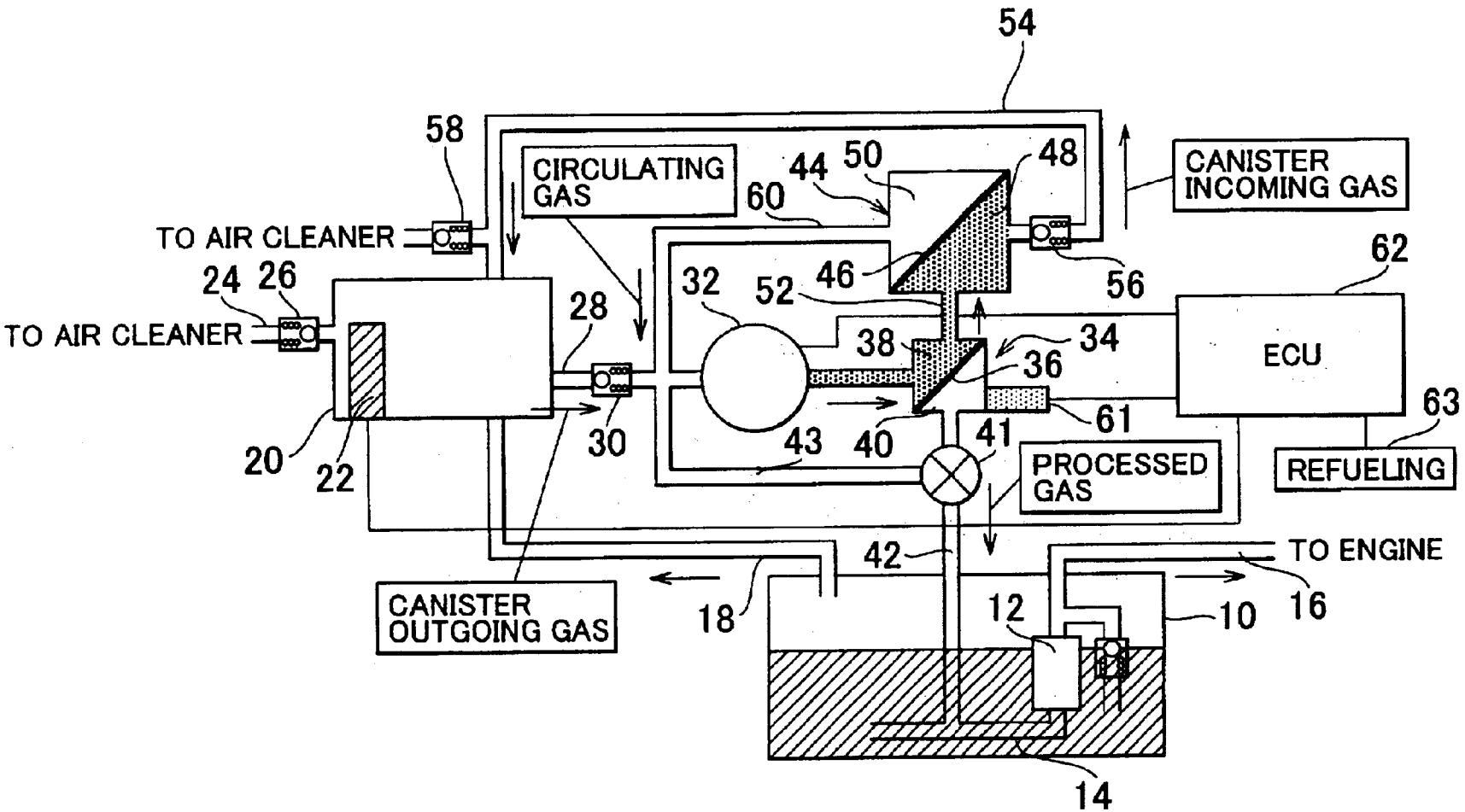
FIG. 1 is a view schematically showing the construction of an evaporative fuel emission control system according to a first embodiment of the invention.

FIG. 1 schematically shows the construction of an evaporative fuel emission control system according to the first embodiment of the invention. As shown in FIG. 1, the system of the first embodiment includes a fuel tank 10. A low-pressure feed pump 12 (which will be simply called "feed pump 12") is disposed inside the fuel tank 10. The feed pump 12 communicates with a suction pipe 14 for sucking up fuel in the fuel tank 10, and also communicates with a fuel pipe 16 through which the fuel is fed to an internal combustion engine that is not illustrated in FIG. 1.

The fuel tank 10 communicates with a canister 20 via a vapor passage 18. The canister 20 contains activated carbon. Fuel vapor generated in the fuel tank 10 flows into the canister 20 through the vapor passage 18, and is adsorbed on the activated carbon within the canister 20.

A heater 22 is disposed in the canister 20 along with the activated carbon. The heater 22 serves to heat the activated carbon to an appropriate temperature. The canister 20 also includes an atmosphere port 24. The atmosphere port 24 is provided with an over pressure prevention valve 26 for preventing an excessively high pressure from developing within the canister 20. The over pressure prevention valve 26 is a one-way valve that only allows flow of fluid that comes out of the canister 20, and is open to the atmosphere via an air cleaner (not shown).

A purge passage 28 communicates with the canister 20. The purge passage 28 is provided with a negative-pressure control valve 30, and is connected to an inlet port of a purge gas circulation pump 32 at a location downstream of the control valve 30. The negative-pressure control valve 30 is a one-way valve that only allows flow of fluid from the canister 20 toward the purge gas circulation pump 32, and operates to create a certain negative pressure at around the inlet port of the purge gas circulation pump 32 during an operation of the pump 32.

A high-concentration gas separation unit 34 is connected to a delivery port of the purge gas circulation pump 32. The high-concentration gas separation unit 34 is provided with a first separation film 36, and includes a first chamber 38 and a second chamber 40 that are separated or partitioned from each other by the first separation film 36. The above-described purge gas circulation pump 32 communicates with the first chamber 38 of the high-concentration gas separation unit 34. On the other hand, a processed gas passage 42 and a processed gas circulation passage 43 communicate with the second chamber 40 of the high-concentration gas separation unit 34 via a switching valve 41.

The switching valve 41 serves to communicates the second chamber 40 of the high-concentration gas separation unit 34 with a selected one of the processed gas passage 42 and the processed gas circulation passage 43. The processed gas passage 42 communicates with the suction pipe 14, namely, a suction port of the feed pump 12, within the fuel tank 10. On the other hand, the processed gas circulation passage 43 communicates with the purge passage 28 at a location downstream of the negative-pressure control valve 30. Thus, the processed gas circulation passage 43 communicates with the inlet port of the purge gas circulation pump 32.

A middle-concentration gas separation unit 44 is disposed above the high-concentration gas separation unit 34. The middle-concentration gas separation unit 44 is provided with a second separation film 46, and includes a first chamber 48 and a second chamber 50 that are separated or partitioned from each other by the second separation film 46. The first chamber 48 of the middle-concentration gas separation unit 44 communicates with the first chamber 38 of the high-concentration gas separation unit 34.

The first chamber 48 of the middle-concentration gas separation unit 44 communicates with a canister incoming gas passage 54. The canister incoming gas passage 54 communicates with the above-described canister 20, and permits gas flowing out of the middle-concentration gas separation unit 44 to circulate and flow into the canister 20. Also, the canister incoming gas passage 54 is provided with a pressure regulating valve 56 located in the vicinity of one end portion of the passage 54 on the side of the middle-concentration gas separation unit 44, and a negative-pressure prevention valve 58 located in the vicinity of the other end portion thereof on the side of the canister 20.

The pressure regulating valve 56 is a one-way valve that only allows flow of fluid from the middle-concentration gas separation unit 44 toward the canister 20, and functions to develop a certain positive pressure in an upstream portion thereof, more specifically, in a path that extends from the purge gas circulation pump 32 to the pressure regulating valve 56. On the other hand, the negative-pressure prevention valve 58 communicates with the atmosphere via an air cleaner (not shown), and serves as a one-way valve that only allows flow of the ambient air into the canister incoming gas passage 54. The negative-pressure prevention valve 58 is provided for preventing an unduly large negative pressure from developing within the canister gas passage 54, or within the canister 20.

A circulating gas passage 60 communicates with the second chamber 50 of the middle-concentration gas separation unit 44. The circulating gas passage 60 is also connected to the purge passage 28 at a location thereof downstream of the negative-pressure control valve 30. With this arrangement, the circulating gas passage 60 permits the second chamber 50 of the middle-concentration gas separation unit 44 to be in fluid communication with the inlet port of the purge gas circulation pump 32.

As shown in FIG. 1, the evaporative fuel emission control system of this embodiment includes a concentration sensor 61 for measuring the concentration of fuel in processed gas produced in the second chamber 40 of the high-concentration gas separation unit 34. Also, the system of this embodiment includes an evaporative fuel emission control computer 62, which will be hereinafter called "ECU (Electronic Control Unit)". The ECU 62 is operable to detect the fuel concentration in the processed gas based on an output signal of the concentration sensor 61. Furthermore, the heater 22, purge gas circulation pump 32 and other components as described above are controlled by the ECU 62.

The evaporative fuel emission control system of the first embodiment further includes a refueling detecting unit 63. More specifically, the refueling detecting unit 63 is provided by a fuel remaining amount sensor for detecting the remaining amount of fuel in the fuel tank 10, or an opening detector or sensor for detecting an open state or closed state of a lid opener. The ECU 62 is operable to determine whether refueling is being conducted, based on an output signal of the refueling detection unit 63.

Figure 2:
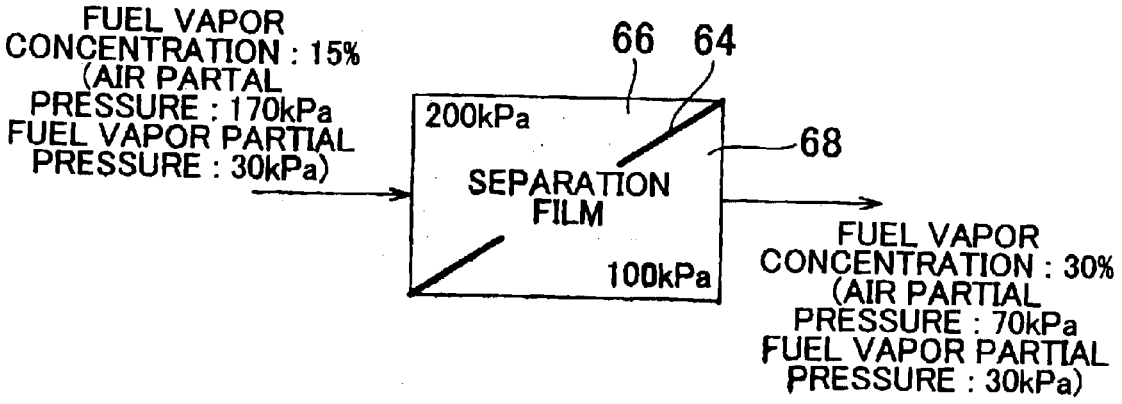
FIG. 2 is a view useful for explaining the principle of working of a separation film provided in the system of the first embodiment.

Referring next to FIG. 2, characteristics of the first separation film 36 and the second separation film 46 will be described.

Each of the first separation film 36 and the second separation film 46 is a thin film composed of a high polymer material, such as polyimide. When the separation film 36, 46 is exposed to a gas containing air and fuel, the film 36, 46 is capable of separating air and fuel from each other, by utilizing a difference between the solubility of air and that of fuel with respect to the film.

FIG. 2 schematically represents the principle with which a separation film 64 having the same structure as the first and second separation films 36, 46 operates to condense fuel vapor. More specifically, FIG. 2 shows a condition in which a gas containing a 15% concentration of fuel vapor is fed to an upstream space 66 (i.e., space on the upper, left-hand side in FIG. 2) of the separation film 64 at a pressure of 30 kPa, while a pressure of 100 kPa is applied to a downstream space 68 (i.e., space on the lower, right-hand side in FIG. 2) of the film 64.

Ideally, the separation film 64 allows fuel vapor to freely pass through the film 64 while inhibiting passage of air therethrough. In this case, the same partial pressure of fuel vapor builds up on the opposite sides of the separation film 64. In the condition as shown in FIG. 2, the partial pressure of air is 170 kPa and the partial pressure of fuel vapor is 30 kPa in the upstream space 66 (200 kPa, 15%) of the separation film 64. Assuming that the same partial pressure of fuel vapor develops on the opposite sides of the separation film 64, the partial pressure of air becomes equal to 70 kPa and the partial pressure of fuel becomes equal to 30 kPa in the downstream space 68. In this case, the concentration of fuel vapor is increased from 15% to 30% due to the function of the separation film 64.

As explained above, when a high-pressure gas is fed to the upstream side of the separation film 64 while the pressure on the downstream side of the film 64 is kept relatively low, the separation film 64 used in the present embodiment is able to increase the concentration of fuel vapor contained in the gas. The capability of the separation film 64 to condense the fuel vapor is enhanced as a difference between the pressures created on the opposite sides of the separation film 64 increases, in other words, as the pressure applied to the downstream side of the separation film 64 decreases. Thus, the first separation film 36 and the second separation film 46 exhibit improved capability of condensing fuel vapor, when higher pressures are applied to the upstream sides (i.e., first chamber 38, 48) of the films 36, 46, and lower pressures are applied to the downstream sides (i.e., second chambers 40, 50) of the films 36, 46.

Referring again to FIG. 1, an operation of the evaporative fuel emission control system of the first embodiment will be described.

In the first embodiment, the ECU 62 actuates the purge gas circulation pump 32 when a certain purge condition is established. In this embodiment, the purge condition is established only when the concentration of fuel in the canister outgoing gas is equal to or higher than a predetermined value, more specifically, is equal to or higher than 15%. Thus, the purge gas circulation pump 32 operates only when the concentration of fuel in the canister outgoing gas is equal to or higher than 15%.

Upon actuation of the purge gas circulation pump 32, a negative pressure created at the inlet port of the pump 32 is applied to the canister 20, so that canister outgoing gas flows from the canister 20 into the purge passage 28. The negative pressure created by the purge gas circulation pump 32 is also applied to the second chamber 50 of the middle-concentration gas separation unit 44. As a result, the purge gas circulation pump 32 operates, in a steady state, to compress a mixed gas as a mixture of the canister outgoing gas supplied from the purge passage 28 and circulating gas supplied from the circulating gas passage 60, and delivers the compressed mixed gas to the first chamber 38 of the high-concentration gas separation unit 34. In the present embodiment, the negative pressure created by the purge gas circulation pump 32 is also applied to the processed gas circulation passage 43.

When the purge gas circulation pump 32 operates in the manner as described above, a delivery pressure of the pump 32 is applied to a system that extends from the delivery port of the pump 32 to the pressure regulating valve 56. On the other hand, the second chamber 40 of the high-concentration gas separation unit 34 receives a selected one of the fuel tank pressure and the negative pressure created by the pump 32, depending upon the selected state of the switching valve 41. Also, the negative pressure created by the pump 32 is applied to the second chamber 50 of the middle-concentration gas separation unit 44. In this case, differential pressures suitable for condensation of evaporative fuel gas are developed on the opposite sides of the first separation film 36 and on the opposite sides of the second separation film 46. During the operation of the purge gas circulation pump 32, therefore, the high-concentration gas separation unit 34 and the middle-concentration gas separation unit 44 perform the function of condensing the evaporative fuel gas.

More specifically, when the purge gas circulation pump 32 is actuated to deliver a mixed gas to the first chamber 38 of the high-concentration gas separation unit 34, fuel vapor in the mixed gas is condensed by means of the first separation film 36, and a high-concentration processed gas (having a high concentration of fuel vapor) is produced in the second chamber 40 of the unit 34. The processed gas thus produced passes through the switching valve 41, to be supplied to the processed gas passage 42 or the processed gas circulation passage 43.

The concentration of fuel in the mixed gas introduced into the first chamber 38 of the high-concentration gas separation unit 34 is reduced as a result of the condensing process performed by the first separation film 36. The mixed gas whose fuel concentration has been reduced in this manner will be hereinafter called "middle-concentration gas". The middle-concentration gas flows out of the first chamber 38 of the high-concentration gas separation unit 38, and then flows into the first chamber 48 of the middle-concentration gas separation unit 44. When the middle-concentration gas flows into the first chamber 48 of the middle-concentration gas separation unit 44, fuel vapor in the gas is condensed by means of the second separation film 46, and a circulating gas having a higher fuel concentration than the middle-concentration gas is produced in the second chamber 50 of the unit 44. The circulating gas thus produced is supplied to the inlet port of the purge gas circulation pump 32 through the circulating gas passage 60.

The evaporative fuel emission control system of the first embodiment operates in a steady state such that the fuel concentration in the circulating gas that flows through the circulating gas passage 60 becomes equal to about 65% when the fuel concentration in the canister outgoing gas is 15%. In this case, the fuel concentration in the mixed gas flowing out of the pump 32 becomes equal to about 60%. The high-concentration gas separation unit 34 is designed to separate the mixed gas having about 60% of fuel vapor into a processed gas having 95% or more of fuel vapor and a middle-concentration gas having about 40% of fuel vapor. Furthermore, the middle-concentration gas separation unit 44 is designed to separate the supplied middle-concentration gas having about 40% of fuel vapor into a circulating gas having about 65% of fuel vapor and a canister incoming gas having less than 5% of fuel vapor. With the system of this embodiment operating in a steady state, the processed gas having 95% or more of fuel vapor and the canister incoming gas having less than 5% of fuel vapor can be eventually produced.

The feed pump 12 is capable of raising the pressure of fuel to about 300 kPa. When such a high pressure is applied to the processed gas introduced into the feed pump 12, the fuel vapor in the processed gas turns into liquid fuel. If a large amount of air is contained in the processed gas, the feed pump 12 may suffer from certain problems, such as vapor lock and harmful noise. If only a small amount of air is contained in the processed gas, on the other hand, no such problems occur since the air dissolves into the fuel when the processed gas is pressurized.

The ratio of air to fuel that will not cause vapor lock or harmful noise is determined depending upon the fuel delivery capability of the feed pump 12, namely, the flow rate and pressure of fuel delivered by the feed pump 12. If the concentration of air in the process gas is less than 5%, namely, if the concentration of fuel in the processed gas is equal to or greater than 95%, a feed pump (e.g., the feed pump 12) generally installed on a vehicle will not suffer from problems of vapor lock and harmful noise. In the present embodiment, therefore, the evaporative fuel emission control system, when used along with the general feed pump 12 installed on the vehicle, is able to circulate the processed gas into the fuel tank 10 without causing the problems of vapor lock and harmful noise.

In the system of the first embodiment, the canister incoming gas is reused for purging fuel vapor stored in the canister 20. By passing a gas having a sufficiently low fuel concentration through the interior of the canister 20, the fuel vapor stored in the canister 20 is purged. In the system of this embodiment, the fuel concentration in the canister incoming gas is restricted to be equal to or lower than 5%. Furthermore, the system causes the heater 22 to heat the canister 20 during purging of fuel vapor. In this connection, fuel vapor stored in the canister 20 is likely to be desorbed or released from the canister 20 as the temperature of the canister 20 increases. With the system of the present embodiment, therefore, the fuel vapor can be efficiently purged with the canister incoming gas.

In the evaporative fuel emission control system of the first embodiment, the fuel concentration in the processed gas can be made equal to or higher than 95% when the system is in a steady state in which the fuel concentration in the mixed gas is around 60%. In other cases, such as immediately after start of the operation of the purge gas circulation pump 32, however, mixed gas having a low fuel concentration, which is significantly lower than 60%, may flow into the high-concentration gas separation unit 34. In this case, processed gas having a lower fuel concentration than 95% is produced in the second chamber 40 of the high-concentration gas separation unit 34.

If the processed gas having a lower fuel concentration than 95% passes through the processed gas passage 42 and is supplied to the feed pump 12, the feed pump 12 may suffer from such problems as vapor lock and harmful noise, and, in addition, errors in the fuel injection quantity may increase due to the presence of bubbles in fuel to be injected. In view of these problems, the system of the present embodiment is adapted to detect the fuel concentration in the processed gas based on the output signal of the concentration sensor 61, and switch the switching valve 41 so that the processed gas flows into the processed gas circulation passage 43 when the detected fuel concentration is lower than a target value (e.g., 95%).

Figure 3:
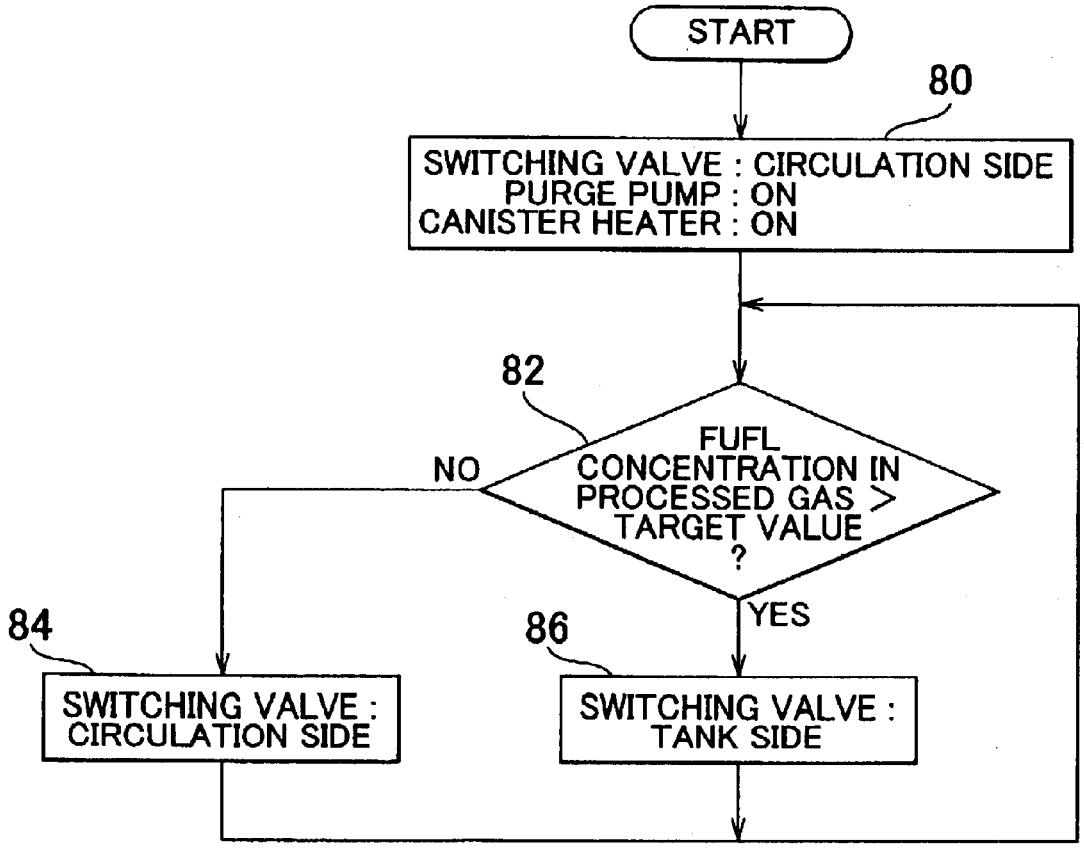
FIG. 3 is a flowchart of a control routine executed by the system of the first embodiment.

FIG. 3 is a flowchart of a control routine that is executed by the ECU 62 in the first embodiment, so as to realize the above-described functions. The routine shown in FIG. 3 is initiated at the same time as a start of the internal combustion engine, and is repeatedly executed until the engine stops.

In step 80 of the routine shown in FIG. 3, the switching valve 41 is switched to the circulation side so that the second chamber 40 of the high-concentration gas separation unit 34 communicates with the processed gas circulation passage 43, and the purge gas circulation pump 32 and the heater 22 are turned ON.

When the purge gas circulation pump 32 starts operating upon execution of step 80, fuel vapor gas starts flowing through the interior of the system. As a result, processed gas obtained by condensing mixed gas is produced in the second chamber 40 of the high-concentration gas separation unit 34. The processed gas thus produced is supplied to the processed gas circulation passage 43, but not to the processed gas passage 42. Thus, in the system of the present embodiment, even if processed gas having a low fuel concentration is produced in the second chamber 40 immediately after the start of the purge gas circulation pump 32, the processed gas can be surely prevented from being supplied to the feed pump 12.

In step 82 of the routine shown in FIG. 3, it is determined whether the concentration of fuel in the processed gas is equal to or higher than a target value, e.g., 95%, based on the output signal of the concentration sensor 61.

If it is determined in step 82 that the fuel concentration in the processed gas is not higher than the target value, the switching valve 41 is controlled to the circulation side for communicating the second chamber 40 with the processed gas circulation passage 43 in step 84. According to the routine shown in FIG. 3, therefore, the processed gas having a low fuel concentration is surely prevented from being introduced into the feed pump 12.

If it is determined in step 82 that the fuel concentration in the processed gas is higher than the target value, the switching valve 41 is switched to the side of the fuel tank 10 in step 86 so that the second chamber 40 of the high-concentration gas separation unit 34 communicates with the inlet port of the feed pump 12. With this operation, the processed gas immediately starts being collected or recovered as fuel at the time when the fuel concentration in the processed gas is increased to a level that permits collection of the fuel.

According to the routine shown in FIG. 3 as explained above, the processed gas having a lower fuel concentration than the target value is surely prevented from being introduced into the feed pump 12, and collection of fuel vapor by the feed pump 12 can be immediately started at the time when the fuel concentration reaches the target value. Thus, the system of the present embodiment is able to provide high fuel collection or recovery capability while avoiding problems, such as vapor lock and harmful noise.

In the first embodiment as described above, the fuel concentration in the processed gas is directly measured by the concentration sensor 61, and the operating state or position of the switching valve 41 is controlled based on the concentration thus measured. However, basic data based on which it is determined whether the switching valve 41 is controlled to the circulation side or the side of the fuel tank 10 is not limited to the fuel concentration in the processed gas itself, but may be any characteristic value that is correlated with the fuel concentration in the processed gas.

More specifically, the basic data as described above may be the flow rate of the canister outgoing gas or the canister incoming gas. The flow rate of the canister outgoing gas or canister incoming gas is relatively small when the mixed gas flowing into the high-concentration gas separation unit 34 has a relatively high fuel concentration and a relatively large amount of circulation gas is produced. On the other hand, the flow rate of the canister outgoing gas or canister incoming gas is relatively large when the mixed gas flowing into the high-concentration gas separation unit 34 has a relatively low concentration of fuel and a relatively small amount of circulation gas is produced. Namely, the flow rate of the canister outgoing gas or incoming gas becomes relatively small when the mixed gas has a relatively high fuel concentration and the processed gas has a relatively high fuel concentration, and becomes relatively large when the mixed gas has a low fuel concentration and the circulating gas has a relatively low fuel concentration. Accordingly, the flow rate of the canister outgoing or incoming gas may be used as a characteristic value of the concentration of fuel in the processed gas, and the switching valve 41 may be controlled based on this characteristic value.

In the first embodiment as described above, the switching valve 41 is controlled based on the result of an actual determination whether the fuel concentration in the processed gas reaches the target value. However, the method of controlling the switching valve 41 is not limited to this method. For example, the switching valve 41 may be controlled to the circulation side for a certain period of time (e.g., a predetermined period, or a period up to the point where the accumulated purge flow amount reaches a predetermined value) measured from the start of the operation of the purge gas circulation pump 32, assuming that the fuel concentration in the processed gas is below the target value during this period of time. After a lapse of this period, the switching valve 41 is switched to the side of the fuel tank 10.

In the first embodiment as described above, when the processed gas has a relatively low fuel concentration, the processed gas is circulated to the upstream side of the purge gas circulation pump 32. However, the method of processing the processed gas having a low fuel concentration is not limited to this method, but may be selected from other methods as long as the low-concentration processed gas is not collected by the fuel tank 10. For example, the processed gas having a low fuel concentration may be simply confined in the second chamber 40 of the high-concentration gas separation unit 34, without being circulated to the upstream side of the pump 32.

In the first embodiment as described above, when the processed gas has a low fuel concentration, the processed gas is completely inhibited from flowing into the fuel tank 10. However, the present invention is not limited to this method of processing the processed gas, but any method can be employed according to the invention provided that flow of the processed gas having a low fuel concentration into the fuel tank 10 is restricted or suppressed.

Second Embodiment

Next, a second embodiment of the invention will be described with reference to FIG. 1, FIG. 4 and FIG. 5. The evaporative fuel emission control system of this embodiment can be provided by causing the ECU 62 to execute a routine shown in FIG. 4 in the system constructed as shown in FIG. 1.

The evaporative fuel emission control system of the first embodiment as described above continues to operate the purge gas circulation pump 32 and the heater 22 even when the processed gas has a low concentration of fuel. In the system of the first embodiment, therefore, the operations of the purge gas circulation pump 32 and the heater 22 are continued even when the fuel concentration in the processed gas is reduced upon completion of purging of fuel vapor stored in the canister 20. However, it is desirable to stop the pump 32 and the heater 22 after completion of purge in order to avoid wasteful energy consumption. In the system of the second embodiment, therefore, the pump 32 and the heater 22 are stopped when the fuel concentration in the processed gas is reduced because of completion of purge.

Figure 4:
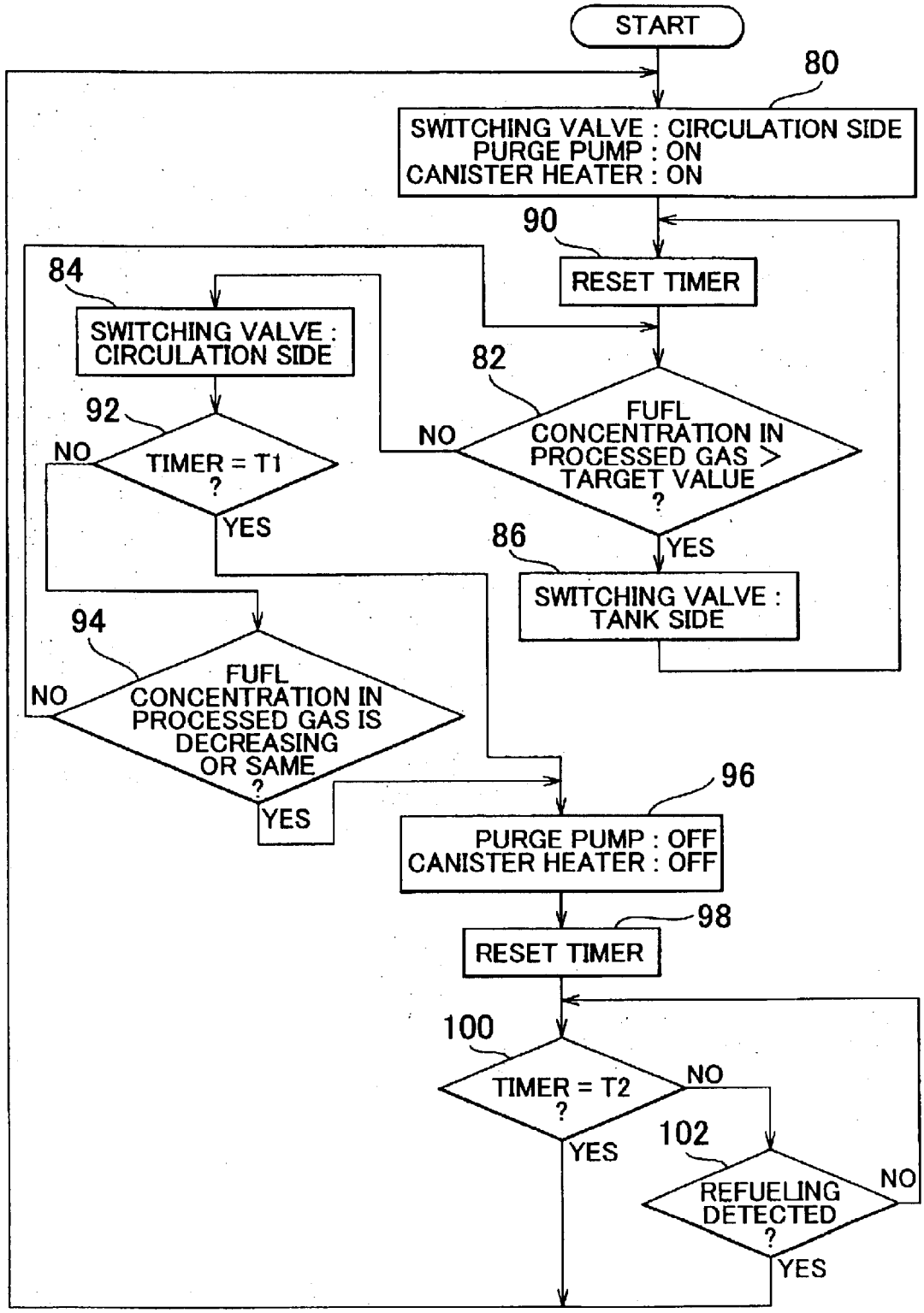
FIG. 4 is a flowchart of a first control routine executed by an evaporative fuel emission control system according to a second embodiment of the invention.

FIG. 4 is a flowchart of a control routine executed by the ECU 62 in the second embodiment to realize the above-described function. In FIG. 4, the same step numbers used in the flowchart of FIG. 3 are assigned to the same steps as those shown in FIG. 3, of which no description or only brief description is provided.

Like the above-described routine shown in FIG. 3, the routine shown in FIG. 4 is initiated at the time of a start of the internal combustion engine, and is repeatedly executed until the engine stops. In the routine shown in FIG. 4, a timer is reset to zero in step 90 after the operation of step 80, namely, after a process of initiating a purging operation with the switching valve 41 controlled to the circulation side is executed. Here, the timer is used for counting a low-concentration period, namely, a period of time in which the concentration of fuel in the processed gas is lower than the target value. The value of the timer is incremented through another routine.

In the routine shown in FIG. 4, step 90 is followed by step 82 in which it is determined whether the concentration of fuel in the processed gas is higher than the target value. In the system of the present embodiment, it may be determined that the fuel concentration in the processed gas is not higher than the target value immediately after start of purging of fuel vapor or after completion of purging of fuel vapor. If the current control cycle is executed immediately after start of purging, therefore, it may be determined in step 82 that the fuel concentration in the processed gas is not higher than the target value.

In the routine shown in FIG. 4, if it is determined in step 82 that the fuel concentration in the processed gas is not higher than the target value, step 84 is executed to control the switching valve 41 to the circulation side, and it is then determined in step 92 whether the value of the timer has reached a predetermined stop judgment time T1.

The stop judgement time T1 is determined as a period of time required for the fuel concentration in the processed gas to increase up to the target value when purging is started under a condition where fuel vapor to be purged is present or stored in the canister 20. If the current control cycle is executed immediately after a start of purge, therefore, it is determined in step 92 that the value of the timer has not reached the stop judgment time T1.

In this case, it is determined in step 94 whether the fuel concentration in the processed gas has a tendency of decreasing or a tendency of being maintained at substantially the same level.

When fuel vapor to be purged is stored in the canister 20, the fuel concentration in the processed gas may temporarily become lower than the target value immediately after purge is started, as described above. In this case, however, the canister outgoing gas starts flowing through the system upon the start of purge, and the fuel concentration in the processed gas shows a tendency of increasing without fail. Accordingly, if the current control cycle is executed under a condition in which evaporative fuel vapor to be purged is stored in the canister 20, it is determined in step 94 that the fuel concentration in the processed gas does not have a tendency of decreasing or being maintained at substantially the same level. In this case, the operations of step 82 and the following steps (steps 84, 92 and 94) are repeated.

When purge is started under a condition in which fuel vapor to be purged is stored in the canister 20, the above-described series of operations are repeatedly executed until it is determined in step 82 that the fuel concentration in the processed gas exceeds the target value. If it is determined that the fuel concentration in the processed gas exceeds the target value, step 86 is executed to switch the switching valve 41 to the fuel tank side. As a result, the processed gas having a fuel concentration that is higher than the target value starts being collected in the fuel tank 10.

In the routine shown in FIG. 4, steps 90, 82 and 86 are repeatedly executed as long as the fuel concentration in the processed gas exceeds the target value. While the operations of these steps are being repeated, the fuel vapor stored in the canister 20 is continuously purged. As a result, purging of the fuel vapor proceeds until no fuel vapor to be purged remains in the canister 20.

If no fuel vapor to be purged exists in the canister 20, the fuel concentration in the processed gas becomes smaller than the target value, and the condition of step 82 is not satisfied again. As a result, the switching valve 41 is switched to the circulation side in step 84, and the processed gas produced in the high-concentration gas separation unit 34 starts being circulated toward the upstream side of the purge gas circulation pump 32.

In the routine shown in FIG. 4, step 84 is followed by step 92 in which it is determined again whether the value of the timer has reached the stop judgment time T1.

As described above, the stop judgment time T1 is a period of time required for the fuel concentration in the processed gas to increase up to the target value when fuel vapor to be purged is present in the canister 20. Accordingly, it is determined in step 92 that the value of the timer has reached the stop judgment time T1 only when no fuel vapor to be purged is present in the canister 20. Thus, in the routine shown in FIG. 4, it is judged that purging of evaporative fuel vapor is completed when the condition of step 92 is satisfied.

If it is determined in step 92 that the value of the timer has not reached the stop judgment time T1, on the other hand, completion of purge cannot be determined with certainty from this fact. In this case, it is determined again in step 94 whether the fuel concentration in the processed gas has a tendency of decreasing or being maintained at substantially the same level.

If any fuel vapor to be purged exists in the canister 20, the fuel concentration in the processed gas shows a tendency of increasing, as described above. Accordingly, when it is determined in step 94 that the fuel concentration in the processed gas has a tendency of decreasing or being maintained at the same level, it can be judged with certainty that no fuel vapor to be purged is present in the canister 20 even before the stop judgment time T1 expires.

If it is determined in step 94 that the above-described condition is not satisfied, on the other hand, step 82 is executed again. Since the fuel concentration in the processed gas does not exceed the target value if no fuel vapor to be purged exists in the canister 20, steps 82, 84, 92 and 94 as described above are repeated until the condition of step 92 or step 94 is satisfied. When no fuel vapor to be purged exists in the canister 20, therefore, the condition of step 92 or step 94 is satisfied sooner or later.

In the routine shown in FIG. 4, if the condition of step 92 or step 94 is satisfied, step 96 is executed to turn OFF both the purge gas circulation pump 32 and the heater 22 so that the operation of the evaporative fuel emission control system is stopped. Thus, according to the routine shown in FIG. 4, the pump 32 and the heater 22 can be stopped when no fuel vapor to be purged exists in the canister 20.

In the routine shown in FIG. 4, the timer is reset to zero in step 98. After execution of step 98, the timer is used for counting a period of time in which the evaporative fuel emission control system is stopped.

In the next step 100, it is determined whether the value of the timer has reached a re-start judgment time T2 (which will be described later). While the evaporative fuel emission control system is stopped, fuel vapor that is newly generated in the fuel tank 10 are adsorbed in the canister 20. Therefore, if the system is held in the stopped condition for an unduly long period of time, the fuel vapor may overflow the canister 20 and leak into the atmosphere. The re-start judgment time T2 as indicated above is defined as a standard period of time during which the evaporative fuel emission control system can be kept stopped without causing such leak of fuel vapor. A method of setting the re-start judgment time will be described later in detail with reference to FIG. 5.

If it is determined in step 100 that the value of the timer has reached the re-start judgment time T2, it can be judged that the evaporative fuel emission control system should be now re-started. In this case, step 80 and the following steps are executed immediately after execution of step 100, and purging of fuel vapor is re-started.

If it is determined in step 100 that the value of the timer has not reached the re-start judgment time T2, it is normally judged that the system can be maintained in the stopped condition. In this case, it is determined in step 102 whether refueling is being carried out, based on an output signal of the refueling detecting unit 63.

When refueling is carried out, a large amount of fuel vapor that exists in the empty space of the fuel tank 10 flow out of the tank 10 toward the canister 20 at a time. Thus, when refueling is conducted, it is desirable to re-start purging of fuel vapor even if the period in which the system is stopped has not reached the re-start judgment time T2.

In the routine shown in FIG. 4, if no refueling is detected in step 102, step 100 is executed again. Thus, the evaporative fuel emission control system is kept stopped until the re-start judgment time T2 expires, or until refueling is detected.

If refueling is detected in step 102, on the other hand, step 80 and the following steps are executed again immediately after execution of step 102. As a result, the purge gas circulation pump 32 and the heater 22 are turned ON and brought into the operating states, and purging of fuel vapor is re-started.

According to the routine shown in FIG. 4, when the fuel concentration in the processed gas has not reached the target value, the processed gas is circulated toward the inlet port of the purge gas circulation pump 32 so that the low-concentration gas is prevented from flowing into the fuel tank 10, as explained above.

When the condition in which the fuel concentration in the processed gas is lower than the target value continues for the stop judgment time T1, it is judged at the time of expiration of the period T1 that purging of fuel vapor is completed, and the purge gas circulation pump 32 and the heater 22 are stopped.

If the fuel concentration in the processed gas has a tendency of decreasing or being maintained at substantially the same level, it is judged at this point of time that purging of fuel vapor is completed even before the stop judgment time T1 expires, and the purge gas circulation pump 32 and the heater 22 can be stopped.

When the re-start judgment time T2 elapses after stop of the evaporative fuel emission control system, purging of fuel vapor is re-started so as to prevent the fuel vapor from leaking or bleeding into the atmosphere.

In addition, if refueling is carried out after stop of the system, purging of fuel vapor is immediately re-started even if the re-start judgment time T2 has not passed, so as to prevent leak of fuel vapor into the atmosphere.

Thus, the evaporative fuel emission control system of the second embodiment is able to effectively prevent leak of evaporative fuel vapor into the atmosphere, while sufficiently suppressing wasteful energy consumption.

Figure 5:
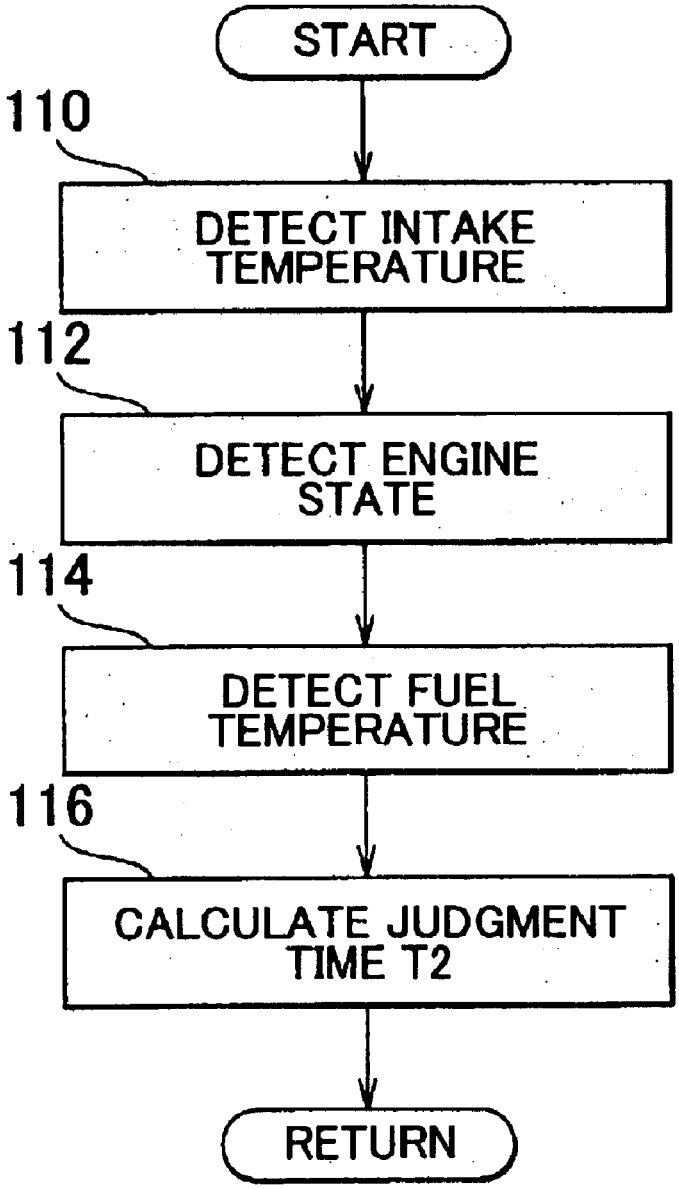
FIG. 5 is a flowchart of a second control routine executed by the system of the second embodiment.

FIG. 5 is a flowchart of a control routine that is executed by the ECU 62 so as to determine the re-start judgment time T2 used in step 100 in the above-described routine shown in FIG. 4.

In the routine shown in FIG. 5, step 110 is initially executed to detect the temperature of intake air, based on an output signal of an intake air temperature sensor (not shown) provided in the internal combustion engine.

In the next step 112, the operating state of the internal combustion engine is detected. The operating state of the internal combustion engine may be represented by, for example, the engine speed, flow rate of the intake air, fuel injection quantity, or the like. The engine speed and the flow rate of the intake air can be respectively detected based on output signals of an engine speed sensor (not shown) and an air flow meter (not shown), which are incorporated in the internal combustion engine. The fuel injection quantity can be detected by reading a value calculated by a control unit (not shown) for engine control.

In the next step 114, the temperature of fuel in the fuel tank 10 is estimated, based on the intake air temperature detected in step 110 and the operating state of the engine detected in step 112. The fuel temperature increases as the temperature of the ambient air (or the temperature of the intake air) increases. Also, the fuel temperature increases as the internal combustion engine operates at a higher load, namely, as a larger amount of exhaust heat is generated. Thus, the fuel temperature and the intake air temperature are correlated with each other, and the fuel temperature and the operating state of the engine are correlated with each other. In the present embodiment, the ECU 62 stores a map that is plotted based on these relationships. In step 114 of FIG. 5, the fuel temperature corresponding to the intake air temperature and the operating state of the engine is estimated with reference to referring to the map.

In the routine shown in FIG. 5, step 114 is followed by step 116 in which the re-start judgment time T2 is calculated based on the estimated fuel temperature. The re-start judgment time T2 is a period of time during which the evaporative fuel emission control system can be kept stopped while preventing leak of fuel vapor into the atmosphere. Thus, it is desirable to set the re-start judgment time T2 to a relatively short time when a relatively large amount of fuel vapor is generated in the fuel tank 10, and set T2 to a relatively long time when a relatively small amount of fuel vapor is generated in the fuel tank 10.

The amount of fuel vapor generated in the fuel tank 10 increases as the fuel temperature increases, and decreases as the fuel temperature decreases. Thus, the re-start judgment time T2 should be set to a shorter time as the fuel temperature is higher, and set to a longer time as the fuel temperature is lower. In the present embodiment, the ECU 62 stores a map that defines the relationship between the fuel temperature and the re-start judgment time T2 so as to satisfy the above requirements. In step 116 of FIG. 5, the re-start judgment time T2 is calculated with reference to this map.

According to the routine shown in FIG. 5, the re-start judgment time T2 can be set to an appropriate time depending upon the condition in which fuel vapor is generated in the fuel tank 10. In the system of the present embodiment, therefore, the period in which the system is kept stopped can be set to an appropriate time depending upon the condition of generation of fuel vapor, while surely avoiding leak of the fuel vapor into the atmosphere and at the same time suppressing wasteful energy consumption (i.e., minimizing energy consumption caused by the operation of the system).

Third Embodiment

Figure 6:
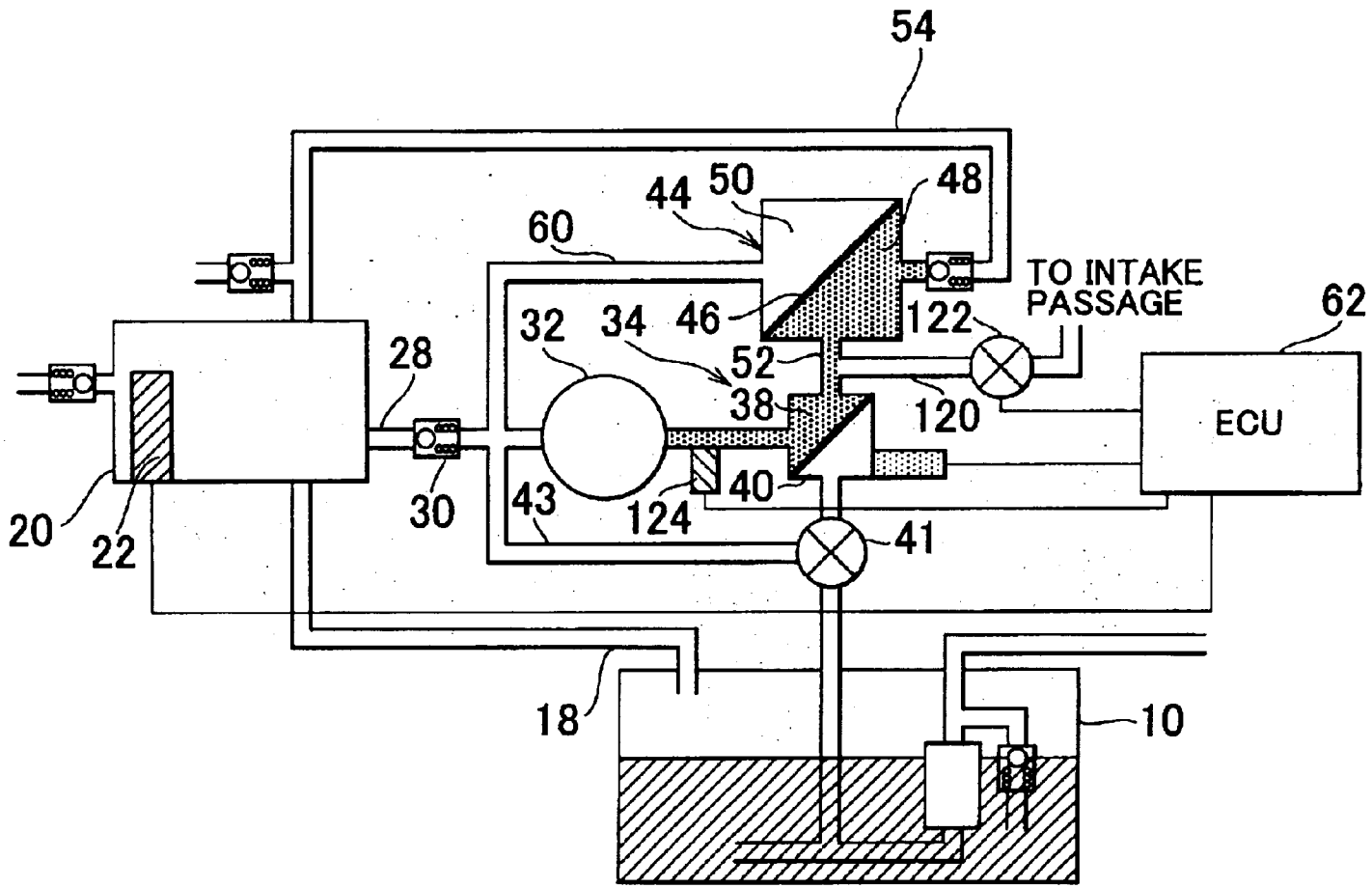
FIG. 6 is a view schematically showing the construction of an evaporative fuel emission control system according to a third embodiment of the invention.

Referring next to FIG. 6, a third embodiment of the invention will be described. The evaporative fuel emission control system of this embodiment includes a vacuum-pressure guide passage 120 that allows a certain point in the system to communicate with the intake passage of the internal combustion engine, a control valve 122 that controls an open/closed state of the passage 120, and a pressure sensor 124 for detecting the pressure in the system, in addition to the structure of the first embodiment as shown in FIG. 1.

In the example shown in FIG. 6, the vacuum-pressure guide passage 120 is connected to a communication path 52 that connects the high-concentration gas separation unit 34 with the middle-concentration gas separation unit 44, and the pressure sensor 124 is disposed between the purge gas circulation pump 32 and the high-concentration gas separation unit 34.

In the third embodiment, the ECU 62 performs similar controls to those of the first and second embodiments during normal operations. During the normal operations, the control valve 122 is always kept in the closed state. In this case, the evaporative fuel emission control system of this embodiment operates in the same manners as in the first embodiment or the second embodiment.

In the present embodiment, the ECU 62 executes an abnormality detecting process in certain timing. In the abnormality detecting process, the switching valve 41 is initially switched to the circulation side, and the control valve 122 is brought into an open state. With the control valve 122 thus opened, the vacuum pressure of the intake air in the engine is guided or applied to the communication path 52 through the vacuum-pressure guide passage 120. This vacuum pressure is then applied to the first chamber 38 of the high-concentration gas separation unit 34 and the first chamber 48 of the middle-concentration gas separation unit 44, via the communication path 52.

The vacuum pressure delivered to the first chamber 38 of the high-concentration gas separation unit 34 passes through the purge gas circulation pump 32 that is stopped, and reaches the purge passage 28. It is to be understood that the pump 32 is designed to allow passage of vacuum pressure when it is stopped. The vacuum pressure that reaches the purge passage 28 is then guided to the second chamber 50 of the middle-concentration gas separation unit 44 via the circulation gas passage 60, and is also guided to the second chamber 40 of the high-concentration gas separation unit 34 via the processed gas circulation passage 43 and the switching valve 41. Furthermore, the vacuum pressure that reaches the purge passage 28 is applied to the canister 20 through the negative-pressure control valve 30. The vacuum pressure thus applied to the canister 20 is then guided to the canister incoming gas passage 54, and is also guided to the fuel tank 10 through the vapor passage 18.

In this manner, once the abnormality detecting process is started, the vacuum pressure of the intake air is applied to the entire region of the evaporative fuel emission control system. Subsequently, the ECU 62 stops introduction of the vacuum pressure by closing the control valve 122 when the pressure within the system is reduced to a predetermined initial pressure. Then, it is determined whether an abnormality, i.e., leak of fuel vapor, occurs in the system, based on a subsequent change in the pressure within the system.

As explained above, the evaporative fuel emission control system of the present embodiment is able to easily determine with high accuracy whether any leak of fuel vapor occurs in any location in the system, by introducing the vacuum pressure into the system and monitoring any change in the pressure within the system following the introduction of the vacuum pressure. With the system of the present embodiment, therefore, the presence of any abnormality that results in leak of fuel vapor can be readily or quickly detected.

While the presence of an abnormality that leads to leak of fuel vapor is determined based on a change in the pressure after introduction of the vacuum into the system in the third embodiment as described above, the method of detecting an abnormality is not limited to this method. For example, the presence of an abnormality that results in leak of fuel vapor may be determined from the rate of change of the pressure during introduction of the vacuum pressure into the system.

While the vacuum-pressure guide passage 120 is connected to the communication path 52 in the third embodiment as described above, the passage 120 may be connected to any location of the system other than the communication path 52, provided that the vacuum pressure is applied to the entire region of the system.

While the pressure sensor 124 is disposed between the purge gas circulation pump 32 and the high-concentration gas separation unit 34 in the third embodiment as described above, the location of the pressure sensor 124 is not limited to this particular location. Namely, the pressure sensor 124 may be disposed at any location as long as the pressure within the system can be detected.

Fourth Embodiment

Figure 7:
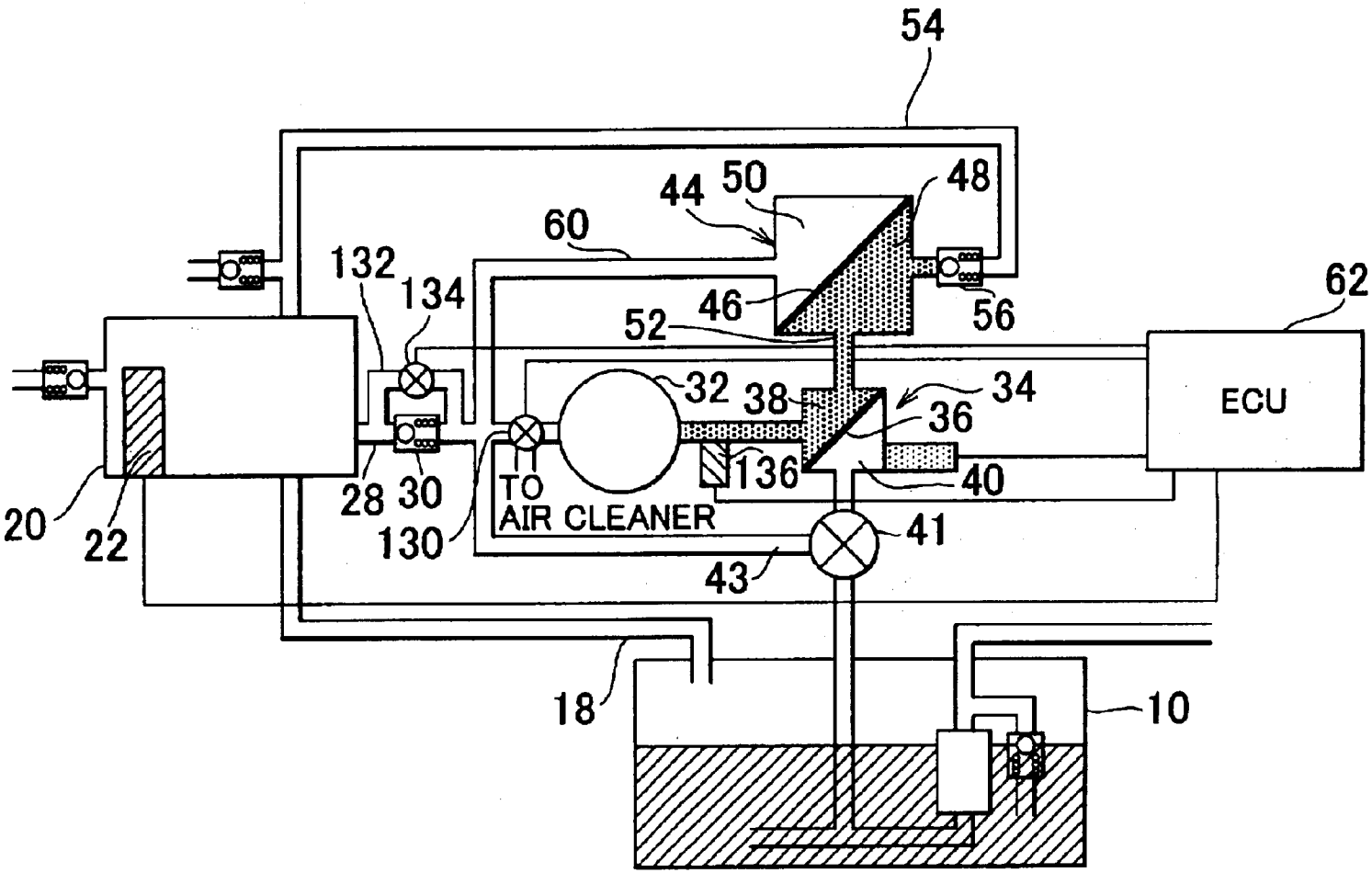
FIG. 7 is a view schematically showing the construction of an evaporative fuel emission control system according to a fourth embodiment of the invention.

Referring next to FIG. 7, a fourth embodiment of the invention will be described. The evaporative fuel emission control system of this embodiment includes an intake air switching valve 130, a bypass passage 132 that bypasses the negative-pressure control valve 30, a bypass control valve 134 that controls an open/closed state of the bypass passage 132, and a pressure sensor 136 for detecting the pressure within the system, in addition to the structure as shown in FIG. 1. The intake air switching valve 130 is adapted to communicate the inlet port of the purge gas circulation pump 32 with a selected one of the purge passage 28 and the atmosphere.

In the fourth embodiment, the ECU 62 performs similar controls to those of the first and second embodiments during normal operations. During the normal operations, the intake air switching valve 130 permits the inlet port of the purge gas circulation pump 32 to communicate with the purge passage 28. Also, the bypass control valve 134 is held in the closed state. In this condition, the evaporative fuel emission control system of this embodiment operates in the same manners as in the first embodiment or the second embodiment.

In the present embodiment, the ECU 62 executes an abnormality detecting process in certain timing. In the abnormality detecting process, the switching valve 41 is initially switched to the circulation side, and the intake air switching valve 130 is switched to the atmosphere side so that the inlet port of the purge gas circulation pump 32 is open to the atmosphere. Furthermore, the bypass control valve 134 is placed in the open state so that fluid can pass through the bypass passage 132. In this condition, an operation of the purge gas circulation pump 32 is started.

During the abnormality detecting process, the purge gas circulation pump 32 pressurizes air taken from the atmosphere, and feeds the pressurized air to the first chamber 38 of the high-concentration gas separation unit 34. This pressurized air reaches the pressure regulating valve 56 via the first chamber 48 of the middle-concentration gas separation unit 44, and further flows into the canister 20 through the pressure regulating valve 56 and the canister incoming gas passage 54. The air that flows into the canister 20 is drawn to the bypass passage 132 through the purge passage 28, and is also drawn to the fuel tank 10 through the vapor passage 18. Furthermore, the air that has passed through the bypass passage 132 is fed to the second chamber 50 of the middle-concentration gas separation unit 44 through the circulation gas passage 60, and is also fed to the second chamber 40 of the high-concentration gas separation unit 34 through the processed gas circulation passage 43.

In this manner, once the abnormality detecting process is started, air delivered from the purge gas circulation pump 32 is guided to the entire region of the evaporative fuel emission control system. As a result, the entire region of the system is brought into a pressurized state. When the pressure within the system increases up to a predetermined initial pressure, the ECU 62 operates to switch the intake air switching valve 130 so that the inlet port of the pump 32 communicates with the purge passage 28, and stop the operation of the pump 32. Then, the ECU 62 determines whether any abnormality that results in leak of fuel vapor arises in the system, based on a change in the pressure within the system after switching of the valve 130 and stop of the pump 32.

As explained above, the evaporative fuel emission control system of the present embodiment is able to easily determine with high accuracy whether leak occurs in any location in the system, by raising the pressure within the system to a certain level and monitoring a change in the pressure within the system that follows the increase of the pressure. With the system of the present embodiment, therefore, the presence of an abnormality that results in leak of fuel vapor can be readily or quickly detected.

While the presence of an abnormality that causes leak of fuel vapor is determined based on a change in the pressure after raising the pressure in the system to a certain level in the fourth embodiment as described above, the method of detecting an abnormality is not limited to this method. For example, the presence of an abnormality that causes leak of fuel vapor may be determined from the rate of change of the pressure during the process of raising the pressure within the system.

While the pressure sensor 136 is disposed between the purge gas circulation pump 32 and the high-concentration gas separation unit 34 in the fourth embodiment as described above, the location of the pressure sensor 136 is not limited to this particular position. Namely, the pressure sensor 136 may be disposed at any location as long as the pressure within the system can be detected.

Fifth Embodiment

Figure 8:
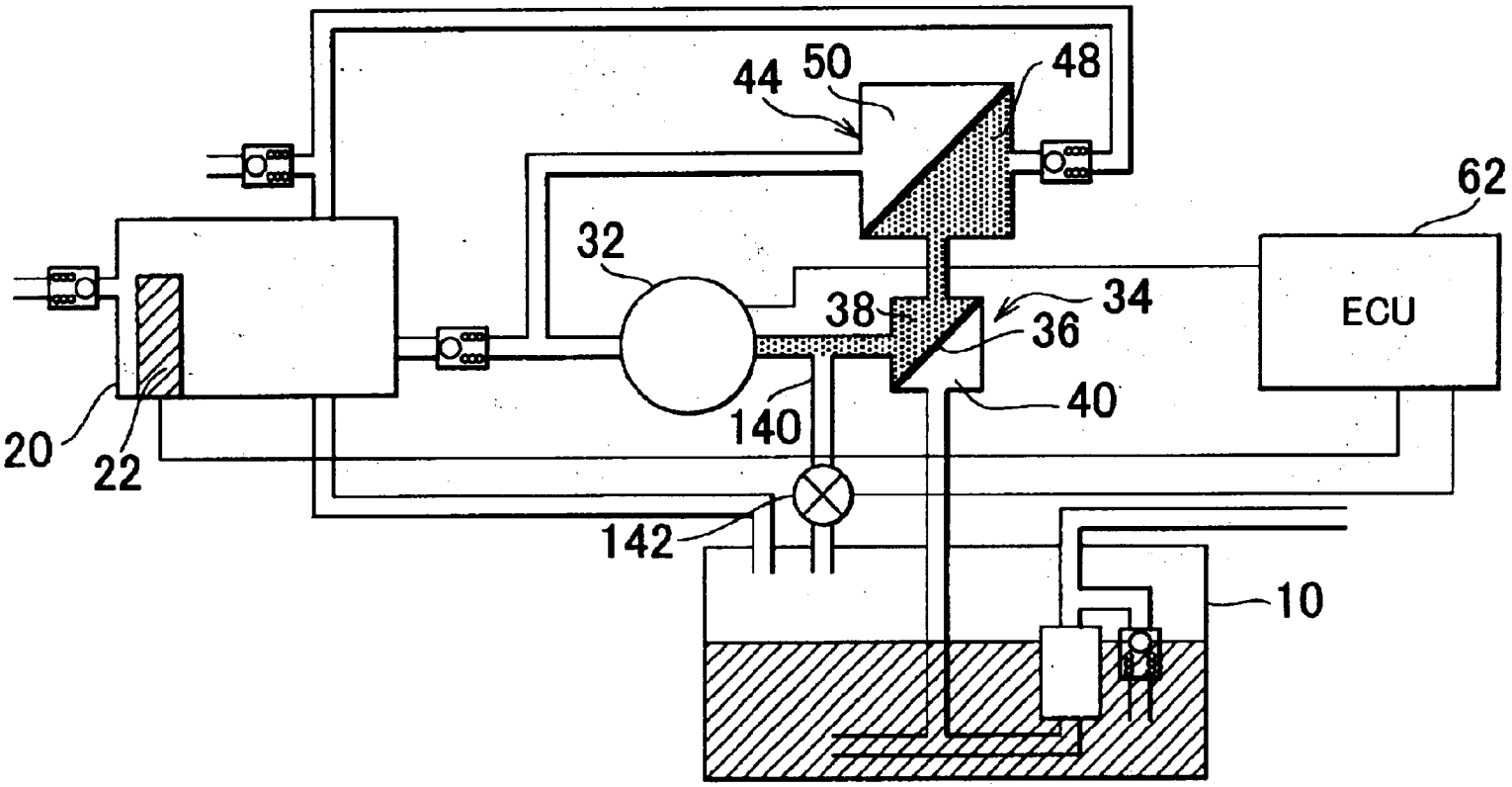
FIG. 8 is a view schematically showing the construction of an evaporative fuel emission control system according to a fifth embodiment of the invention.
Figure 9:
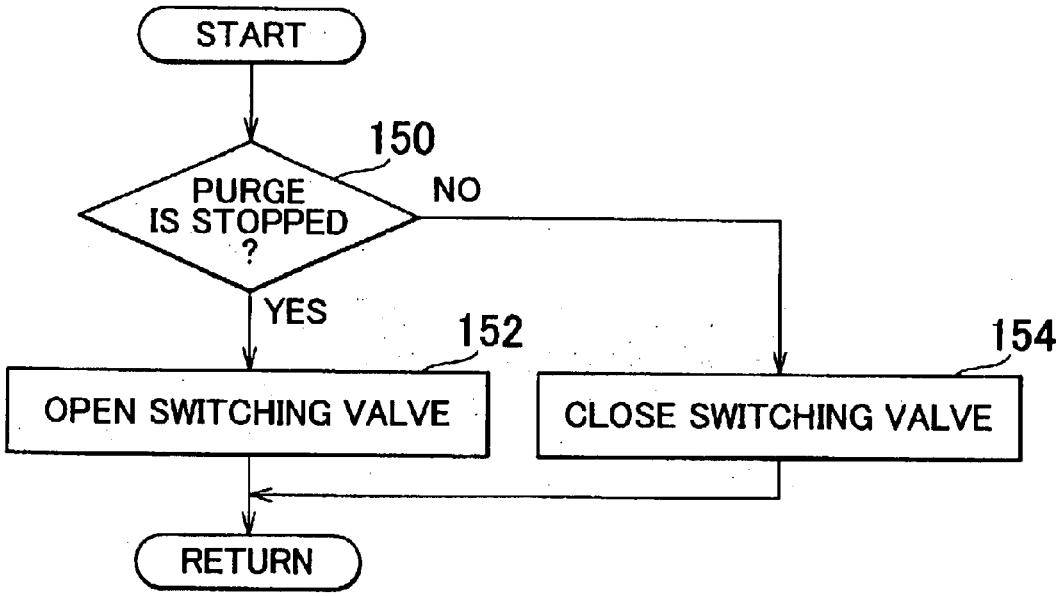
FIG. 9 is a flowchart of a control routine executed by the system of the fifth embodiment.

Referring next to FIG. 8 and FIG. 9, a fifth embodiment of the invention will be described. FIG. 8 schematically shows the construction of an evaporative fuel emission control system of this embodiment. In FIG. 8, the same reference numerals as used in FIG. 1 are used for identifying the same components or portions as those shown in FIG. 1, of which no description or only brief description is provided.

As shown in FIG. 8, the evaporative fuel emission control system of the fifth embodiment includes a bypass passage 140 and a switching valve 142 for switching the bypass passage 140 between an open state and a closed state. The bypass passage 140 bypasses the high-concentration gas separation unit 34, and permits space located downstream of the purge gas circulation pump 32 to communicate with the inner space of the fuel tank 10. The switching valve 142 is a valve mechanism for placing the bypass passage 140 in a selected one of the open state and the closed or shut-off state.

In the evaporative fuel emission control system of the fifth embodiment constructed as shown in FIG. 8, the ECU 62 executes a control routine shown in FIG. 9. FIG. 9 is a flowchart showing the routine executed by the ECU 62 for controlling the open/closed state of the switching valve 142.

In the routine shown in FIG. 9, step 150 is initially executed to determine whether purging of fuel vapor is stopped, more specifically, whether the purge gas circulation pump 32 is stopped.

If step 150 determines that purging of fuel vapor is stopped, the switching valve 142 is placed in the open state in step 152. When the switching valve 142 is opened, the downstream space of the pump 32 is brought into communication with the inner space of the fuel tank 10. In this condition, fuel vapor generated in the fuel tank 10 is introduced into the downstream space of the pump 32. With the system of the present embodiment, therefore, the concentration of fuel in the downstream space of the pump 32 can be maintained at a sufficiently high level even while purging is stopped (i.e., the pump 32 is stopped) and no canister outgoing gas flows through the system.

In the routine shown in FIG. 9, if it is determined in step 150 that purging of fuel vapor is not stopped, namely, the purge gas circulation pump 32 is in operation, the switching valve 142 is placed in the closed state in step 154. When the switching valve 142 is in the closed state, the mixed gas delivered from the pump 32 does not flow into the bypass passage 140, but reaches the high-concentration gas separation unit 34. In this case, the high-concentration gas separation unit 34 and the middle-concentration gas separation unit 44 are able to perform similar condensing processes to those in the case of the first embodiment.

As explained above, the evaporative fuel emission control system of the present embodiment is able to perform fuel vapor condensing functions similar to those of the first or second embodiment when purging of fuel vapor is carried out, and is also able to fill the downstream space of the pump 32 with evaporative fuel gas having a high concentration of fuel during stop of the purging operation. With the downstream space of the pump 32 thus filled with fuel vapor gas having a high fuel concentration during stop of purge, the high-concentration gas separation unit 34 can produce processed gas having a high fuel concentration even immediately after start of purge. Thus, the evaporative fuel emission control system of the present embodiment is able to surely prevent processed gas having a low fuel concentration from flowing into the fuel tank 10, without taking a countermeasure such as circulating processed gas produced immediately after start of purge to the upstream side of the pump 32.

Sixth Embodiment

Figure 10:
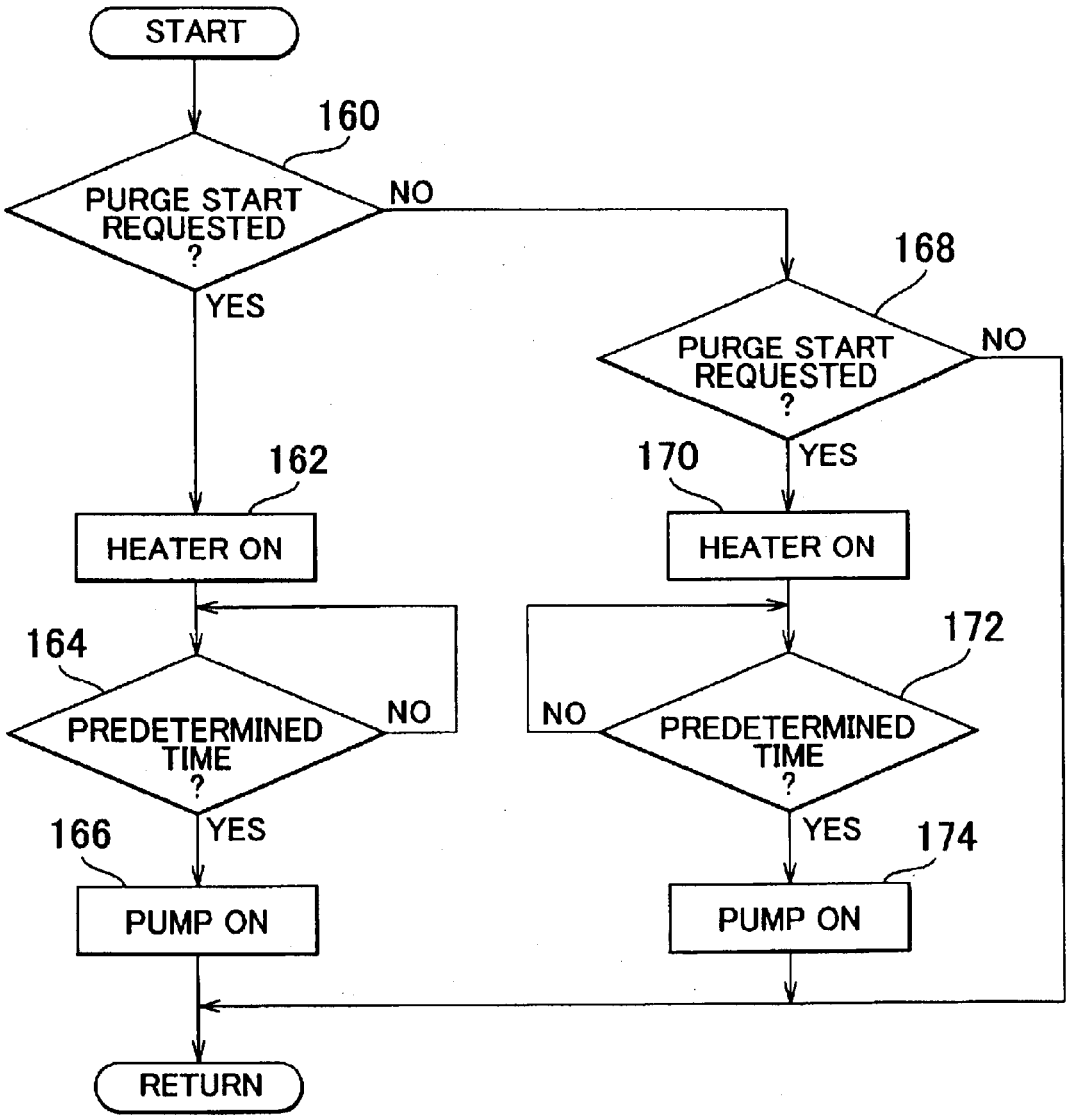
FIG. 10 is a flowchart of a control routine executed by an evaporative fuel emission control system according to a sixth embodiment of the invention.

Referring next to FIG. 1, FIGS. 6–8 and FIG. 10, a sixth embodiment of the invention will be described. The evaporative fuel emission control system of this embodiment may be constructed as shown in any of FIG. 1 and FIGS. 6–8. With the system constructed according to any of the first through fifth embodiments, the ECU 62 executes a routine as shown in FIG. 10 according to the sixth embodiment.

The routine shown in FIG. 10 is executed for creating a desired time difference between the ON/OFF timing of the purge gas circulation pump 32 and the ON/OFF timing of the heater 22.

In the routine shown in FIG. 10, step 160 is initially executed to determine whether a start of purging of fuel vapor is requested. If it is determined that a start of purging is requested, the heater 22 is placed in the ON state in step 162 so as to start heating the canister 20.

In step 164 following step 162, a stand-by condition is maintained for a predetermined period of time until the canister 20 is brought into a desired heated state. If it is determined in step 164 that the predetermined stand-by time has passed, the purge gas circulation pump 32 is placed in the ON state at this point of time in step 166.

With the process as described above, the canister 20 is placed in the desired heated state before the purge gas circulation pump 32 starts operating, so that fuel vapor is likely to be purged upon a start of the pump 32. With the system of the present embodiment, therefore, the high-concentration gas separation unit 34 is supplied with mixed gas having a sufficiently high fuel concentration so as to produce processed gas having a sufficiently high fuel concentration immediately after the start of actual purging of fuel vapor. Accordingly, the system of this embodiment is able to effectively prevent processed gas having a low fuel concentration from flowing into the fuel tank 10 immediately after start of purge.

In the routine shown in FIG. 10, if it is determined in step 160 that start of purging of fuel vapor is not requested, it is then determined in step 168 whether stop of purge is requested. If it is determined that stop of purge is not requested, the current control cycle is immediately terminated. If it is determined that stop of purge is requested, on the other hand, the heater 22 is turned OFF in step 170 so as to stop heating the canister 20.

In step 172 following step 170, purge is continued while the heater 22 is in the OFF state for a predetermined period of time until the canister 20 is cooled down into a desired state. If it is determined in step 172 that the predetermined stand-by time has passed, the purge gas circulation pump 32 is turned OFF at this point of time in step 174.

With the process as described above, the canister 20 can be cooled down by some degree before the purge gas circulation pump 32 is stopped. The canister 20 exhibits greater adsorptive capacity, i.e., higher capability of adsorbing fuel vapor, as the temperature of the canister 20 decreases. With the system of this embodiment, therefore, the canister 20 is able to provide excellent fuel vapor adsorptive capacity while purge is stopped.

As explained above, according to the routine shown in FIG. 10, the heater 22 can be turned ON before the purge gas circulation pump 32 is turned ON upon start of purge, and the heater 22 can be turned OFF before the pump 32 is turned OFF upon stop of purge. In the system of this embodiment, therefore, processed gas having a relatively high concentration of fuel can be collected by the fuel tank 10 immediately after start of purge, and a large amount of fuel vapor can be captured by the canister 20 during stop of purge.

While the heater 22 starts being energized prior to start of an operation of the purge gas circulation pump 32 upon start of purge in the sixth embodiment as described above, the operations of the heater 22 and the pump 32 at the time of start of purge are not limited to those of this embodiment. For example, the purge gas circulation pump 32 and the heater 22 may be actuated at the same time upon start of purge. In this case, too, fuel vapor is more likely to be released from the canister 20 due to the heating function of the heater 22, and therefore canister outgoing gas having a relatively high fuel concentration can be produced from the time immediately after the start of purge.

Seventh Embodiment

Figure 11:
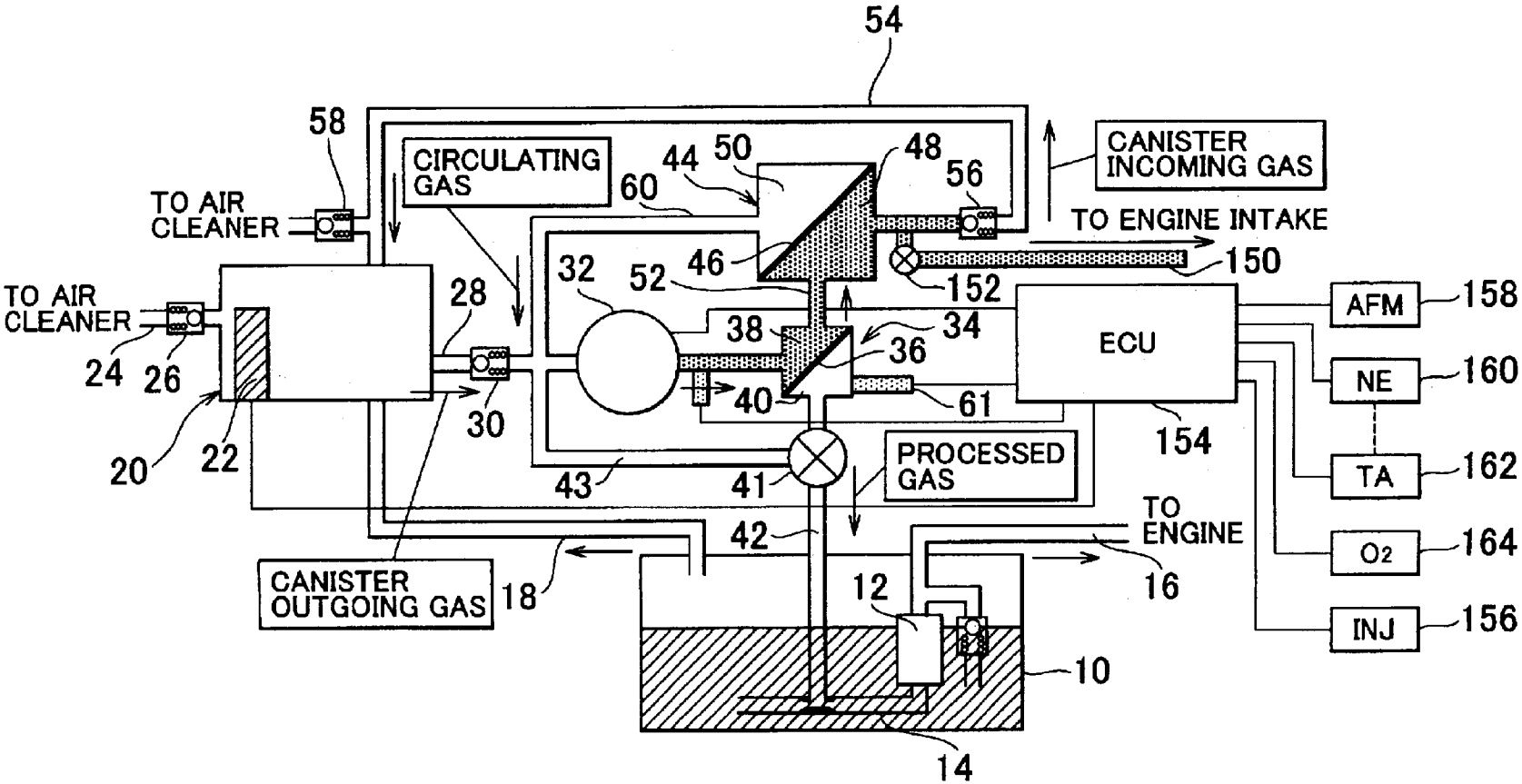
FIG. 11 is a view schematically showing the construction of an evaporative fuel emission control system according to a seventh embodiment of the invention.

FIG. 11 schematically shows the construction of an evaporative fuel emission control system according to a seventh embodiment of the invention. The system of FIG. 11 is similar in construction to that of the first embodiment as shown in FIG. 1, but further includes a low-concentration gas purge passage 150 and a control valve 152 as described below. In addition, the system of FIG. 11 includes an ECU (Electronic Control Unit) 154 that performs additional functions as compared with the ECU 62 of the first embodiment.

More specifically, the low-concentration gas purge passage 150 is connected to a portion of the canister incoming gas passage 54 between the middle-concentration gas separation unit 44 and the pressure regulating valve 56 for fluid communication. The low-concentration gas purge passage 150 includes the control valve 152 for controlling an open/closed state of the passage 150, and communicates with an intake passage of the internal combustion engine at an end portion thereof (not shown) remote from the canister incoming gas passage 54.

In the present embodiment, the above-indicated ECU 154 as a control computer is provided for controlling, for example, the heater 22 and the purge gas circulation pump 32. As shown in FIG. 11, fuel injection valves 156 are connected to the ECU 154. Each of the fuel injection valves 156 is disposed in an intake port of each cylinder of the engine, and is operable to inject fuel fed from the fuel pipe 16 into the cylinder of the engine. To the ECU 154 are also connected sensors for detecting various data required for calculating the fuel injection quantity, namely, the quantity of fuel injected from the fuel injection valve 156.

More specifically, an air flow meter 158, engine speed sensor 160, throttle sensor 162, exhaust $O_2$ sensor 164 and other sensors are connected to the ECU 154. The air flow meter 158 is adapted to detect the flow rate GA of the intake air sucked into the intake passage of the internal combustion engine. The engine speed sensor 160 is adapted to detect the engine speed NE, and the throttle sensor 162 is adapted to detect the opening angle of a throttle valve mounted in the intake passage. The exhaust $O_2$ sensor 164 is disposed in an exhaust passage of the engine, and is adapted to determine whether the exhaust air/fuel ratio is rich or lean.

Purging Operation

Next, an operation of the system of the seventh embodiment for purging fuel vapor stored in the canister 20 will be described.

In the seventh embodiment, the ECU 154 actuates the purge gas circulation pump 32 when a certain purge condition is established. In this embodiment, the purge condition is satisfied only when the concentration of fuel in the canister outgoing gas is equal to or higher than a predetermined value, for example, is equal to or higher than 15%. Thus, the purge gas circulation pump 32 operates only when the fuel concentration in the canister outgoing gas is equal to or higher than 15%.

Upon actuation of the purge gas circulation pump 32, a negative pressure created at the inlet port of the pump 32 is applied to the canister 20, so that canister outgoing gas flows from the canister 20 into the purge passage 28. The negative pressure created by the purge gas circulation pump 32 is also applied to the second chamber 50 of the middle-concentration gas separation unit 44 via the circulating gas passage 60. As a result, the purge gas circulation pump 32 operates, in a steady state, to compress mixed gas as a mixture of the canister outgoing gas supplied from the purge passage 28 and circulating gas supplied from the circulating gas passage 60, and delivers the compressed mixed gas to the first chamber 38 of the high-concentration gas separation unit 34. In this embodiment, the negative pressure created by the purge gas circulation pump 32 is also applied to the processed gas circulation passage 43.

When the purge gas circulation pump 32 operates in the manner as described above, a delivery pressure of the pump 32 is applied to a system that extends from the delivery port of the pump 32 to the pressure regulating valve 56. On the other hand, the second chamber 40 of the high-concentration gas separation unit 34 receives a selected one of the fuel tank pressure and the negative pressure created by the pump 32, depending upon the selected state of the switching valve 41. Also, the negative pressure created by the pump 32 is applied to the second chamber 50 of the middle-concentration gas separation unit 44. In this case, differential pressures are developed between the opposite sides of the first separation film 36 of the high-concentration separation unit 34 and on the opposite sides of the second separation film 46 of the middle-concentration separation unit 44, such that the pressures in the first chambers 38, 48 become higher than those in the second chambers 40, 50, respectively.

Each of the first separation film 36 and the second separation film 46 is a thin film composed of a high polymer material, such as polyimide. When the separation film 36, 46 is exposed to gas containing air and fuel, the film 36, 46 is capable of separating air and fuel from each other, by utilizing a difference between the solubility of air and that of fuel with respect to the film. More specifically, when gas containing fuel vapor is fed to one of the opposite surfaces of the separation film 36, 46 while different pressures are applied to the opposite sides of the film 36, 46 such that the higher pressure is applied to the above-indicated one surface of the film 36, 46 to which the gas is fed, the separation film 36, 46 permits condensed gas having an increased fuel vapor concentration to pass therethrough toward the low-pressure side of the film 36, 46.

When the purge gas circulation pump 32 is actuated to deliver the above-indicated mixed gas to the first chamber 38 of the high-concentration gas separation unit 34 while a differential pressure is developed on the opposite sides of the first separation film 36 such that the pressure in the first chamber 38 becomes higher than that of the second chamber 40, fuel vapor in the mixed gas condenses when passing through the first separation film 36, and the resulting gas is fed to the second chamber 40. As a result, the fuel concentration in the first chamber 38 is reduced as compared with that measured when the mixed gas flows into the first chamber 38, to thus provide "middle-concentration gas" in the first chamber 38, whereas processed gas having a high concentration of fuel vapor is produced in the second chamber 40.

The middle-concentration gas flows out of the first chamber 38 of the high-concentration gas separation unit 38, and then flows into the first chamber 48 of the middle-concentration gas separation unit 44. When the middle-concentration gas flows into the first chamber 48 of the middle-concentration gas separation unit 44, fuel vapor in the middle-concentration gas condenses when passing through the second separation film 46, so that circulating gas having a higher fuel concentration than the middle-concentration gas is produced in the second chamber 50. The circulating gas thus produced is supplied to the inlet port of the purge gas circulation pump 32 through the circulating gas passage 60.

The evaporative fuel emission control system of the seventh embodiment operates in a steady state such that the fuel concentration in the circulating gas becomes equal to about 65% when the fuel concentration in the canister outgoing gas is 15%. In this case, the fuel concentration in the mixed gas becomes equal to about 60%. The high-concentration gas separation unit 34 is designed to separate the mixed gas having about 60% of fuel vapor into a processed gas having 95% or more of fuel vapor and a middle-concentration gas having about 40% of fuel vapor. Furthermore, the middle-concentration gas separation unit 44 is designed to separate the supplied middle-concentration gas having about 40% of fuel vapor into a circulating gas having about 65% of fuel vapor and a canister incoming gas having less than 5% of fuel vapor. With the system of this embodiment operating in a steady state, the processed gas having 95% or more of fuel vapor and the canister incoming gas having less than 5% of fuel vapor can be eventually produced.

The feed pump 12 is capable of raising the pressure of fuel to about 300 kPa. When such a high pressure is applied to the processed gas introduced into the feed pump 12, the fuel vapor in the processed gas turns into liquid fuel. If a large amount of air is contained in the processed gas, the feed pump 12 may suffer from certain problems, such as vapor lock and harmful noise. If only a small amount of air is contained in the processed gas, on the other hand, no such problems occur since the air dissolves into the fuel when the processed gas is pressurized.

The ratio of air to fuel that will not cause vapor lock or harmful noise is determined depending upon the fuel delivery capability of the feed pump 12, namely, the flow rate and pressure of fuel delivered by the feed pump 12. If the concentration of air in the process gas is less than 5%, namely, if the concentration of fuel in the processed gas is equal to or greater than 95%, a feed pump (e.g., the feed pump 12) generally installed on a vehicle will not suffer from problems of vapor lock and harmful noise. In the present embodiment, therefore, the evaporative fuel emission control system, when used along with the general feed pump 12 installed on the vehicle, is able to circulate the processed gas into the fuel tank 10 without causing the problems of vapor lock and harmful noise.

In the system of the seventh embodiment, the canister incoming gas is re-used for purging fuel vapor stored in the canister 20. By passing gas having a sufficiently low fuel concentration through the inside of the canister 20, the fuel vapor stored in the canister 20 is purged. In the system of this embodiment, the fuel concentration in the canister incoming gas is restricted to be equal to or lower than 5%. Furthermore, the system causes the heater 22 to heat the canister 20 during purging of fuel vapor. In this connection, fuel vapor stored in the canister 20 is likely to be desorbed or released from the canister 20 as the temperature of the canister 20 increases. With the system of the present embodiment, therefore, the fuel vapor can be efficiently purged with the canister incoming gas.

In the evaporative fuel emission control system of the seventh embodiment, the fuel concentration in the processed gas can be made equal to or higher than 95% when the system is in a steady state in which the fuel concentration in the mixed gas is around 60%. In other cases, such as immediately after start of the operation of the purge gas circulation pump 32, however, mixed gas having a low fuel concentration, which is significantly lower than 60%, may flow into the high-concentration gas separation unit 34. In this case, processed gas having a lower fuel concentration than 95% is produced in the second chamber 40 of the high-concentration gas separation unit 34.

If the processed gas having a lower fuel concentration than 95% passes through the processed gas passage 42 and is supplied to the feed pump 12, the feed pump 12 may suffer from such problems as vapor lock and harmful noise, and, in addition, errors in the fuel injection quantity may increase due to the presence of bubbles in fuel to be injected. In view of these problems, the system of the present embodiment is adapted to detect the fuel concentration in the processed gas based on the output signal of the concentration sensor 61, and switch the switching valve 41 so that the processed gas flows into the processed gas circulation passage 43 when the detected fuel concentration is lower than a target value (e.g., 95%). Thus, the system of this embodiment is able to effectively avoid or suppress vapor lock and harmful noise even when the fuel concentration in the mixed gas flowing into the high-concentration separation unit 34 is significantly lower than that established when the system is in the steady state as described above.

Fuel Injection Quantity Control

Next, a method in which the system of the seventh embodiment controls the fuel injection quantity will be described.

In the seventh embodiment, the ECU 154 determines a quantity of intake air Ga/NE per revolution, based on output signals of the air flow meter 158 and the engine speed sensor 160. Then, the ECU 154 calculates a fuel injection quantity that realizes a desired air/fuel ratio (e.g., stoichiometric air/fuel ratio) in relation to the quantity (or flow rate) of intake air Ga/NE, as a basic fuel injection quantity. The ECU 154 then calculates a final fuel injection quantity by subjecting the thus calculated basic fuel injection quantity to various correcting operations.

The ECU 154 performs air/fuel ratio feedback control based on an output signal of the exhaust $O_2$ sensor 164, as a control for correcting the fuel injection quantity. In the air/fuel ratio feedback control, an air/fuel ratio feedback factor FAF is calculated as a correction factor for correcting the basic fuel injection quantity. The air/fuel ratio feedback factor FAF is updated in a decreasing direction while the exhaust air/fuel ratio detected by the exhaust $O_2$ sensor 164 is fuel-rich, and is updated in an increasing direction while the detected exhaust air/fuel ratio is fuel-lean. If the basic fuel injection quantity is corrected by using the thus updated FAF, the fuel injection quantity can be gradually reduced while the exhaust air/fuel ratio is rich, and can be gradually increased while the exhaust air/fuel ratio is lean. Thus, according to the air/fuel ratio feedback control, the fuel injection quantity can be increased or reduced so as to keep the exhaust air/fuel ratio at around the stoichiometric air/fuel ratio.

Purging of Canister Incoming Gas and Influence of Purging

The system of this embodiment includes the low-concentration gas purge passage 150 that communicates the canister incoming gas passage 54 with the intake passage of the internal combustion engine, as described above. A positive pressure corresponding to a set pressure of the pressure regulating valve 56 develops in the canister incoming gas passage 54. On the other hand, a vacuum pressure of the intake air develops in the intake passage of the engine. By opening the control valve 152, therefore, the canister incoming gas can be purged into the intake passage of the engine through the low-concentration gas purge passage 150.

The canister incoming gas contains about at least 5% of fuel vapor. Accordingly, if the canister incoming gas is purged into the intake passage, the air/fuel ratio of an air-fuel mixture to be burned in the engine becomes richer than that measured before purging of the canister incoming gas. If the air/fuel ratio changes during the air/fuel ratio feedback control, the air/fuel ratio feedback factor FAF is updated in a decreasing direction so as to make the air/fuel ratio close to the stoichiometric air/fuel ratio. As a result, the air/fuel ratio feedback correction factor FAF changes by an amount ΔFAF corresponding to the amount of fuel vapor supplied to the engine by purging.

Method of Calculating Fuel Concentration of Canister Incoming Gas based on Change Amount ΔFAF In the system of this embodiment as described above, after the canister incoming gas is purged into the intake passage, the air/fuel ratio feedback correction factor FAF changes by the amount ΔFAF corresponding to the amount of fuel vapor supplied to the engine by purge, as described above. In this case, the ECU 154 is able to detect the amount of fuel supplied to the engine by purge, based on the amount of change ΔFAF.

In the meantime, the flow rate of the canister incoming gas purged into the intake passage is determined based on a difference of the pressures that develop on the opposite sides of the low-concentration gas purge passage 150, and the flow resistance of the passage 150. Since the pressure in the canister incoming gas passage 54 can be treated as a fixed value (i.e., set pressure of the pressure regulating valve 56), the difference between the pressures on the opposite sides of the low-concentration gas purge passage 150 can be detected based on the engine intake vacuum. The intake vacuum pressure can be detected by a known method, for example, through an actual measurement using an intake pressure sensor (not shown), or through estimation based on the flow rate of intake air Ga. Thus, the ECU 154 is able to detect the pressure difference arising on the opposite sides of the low-concentration gas purge passage 150 by a known method. The flow resistance of the low-concentration gas purge passage 150 is a value uniquely determined depending upon the selected state or position of the control valve 152. Thus, the ECU 154 is able to calculate the flow rate of the canister incoming gas purged into the engine, based on the pressure difference detected by the known method, and the flow resistance determined by the selected state of the control valve 152.

Once the amount of fuel supplied by purge and the flow rate of gas purged into the engine are determined, the concentration of fuel in the purge gas can be calculated. Thus, the ECU 154 is able to calculate (or estimate) the concentration of fuel in the canister incoming gas, based on the amount of change ΔFAF of the air/fuel ratio feedback factor FAF that occurs after start of purge.

Figure 12:
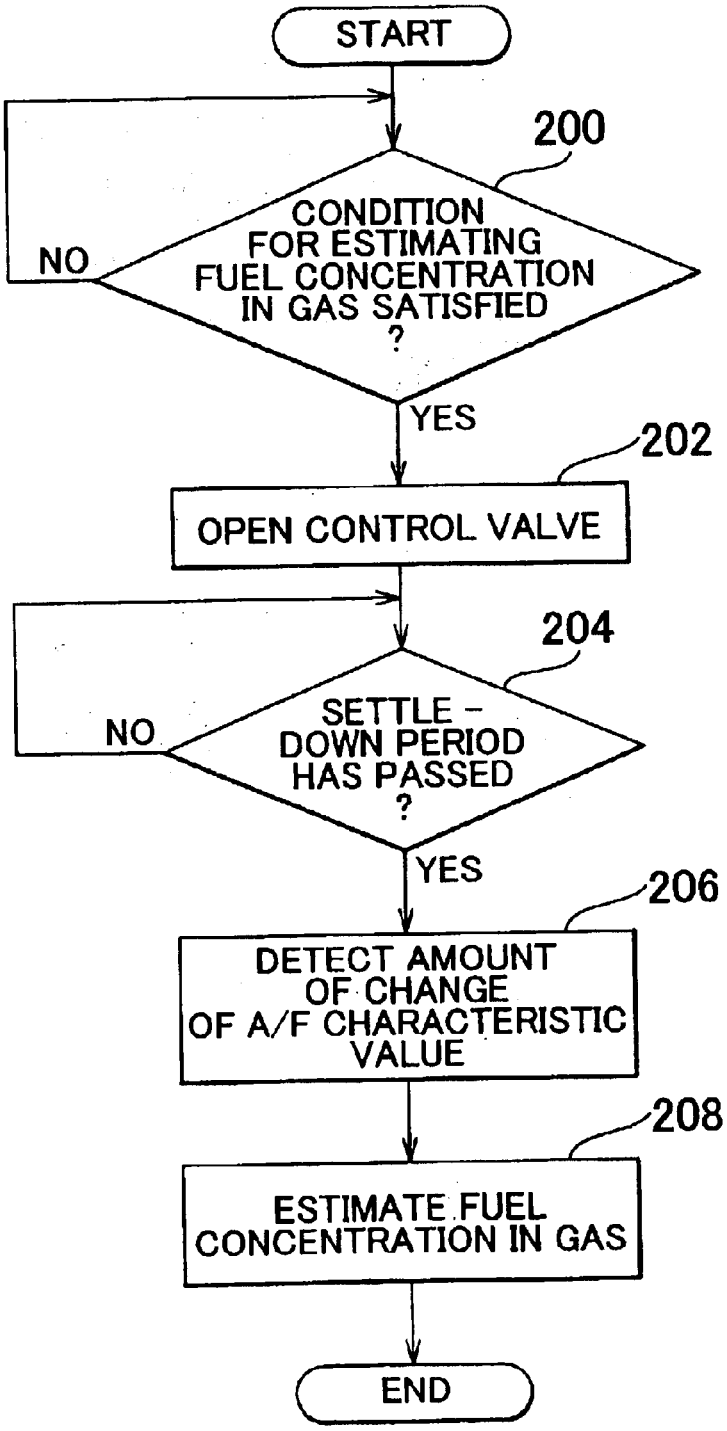
FIG. 12 is a flowchart of a control routine executed for estimating the concentration of fuel in canister incoming gas in the system of the seventh embodiment.

FIG. 12 is a flowchart of a control routine executed by the ECU 154 for estimating the canister incoming gas by the above-described method.

In the routine shown in FIG. 12, step 200 is initially executed to determine whether conditions for estimating the concentration of fuel in the canister incoming gas are satisfied. In order to estimate the fuel concentration in the canister gas by the above-described method, the canister incoming gas needs to be fed to the intake passage of the engine. Therefore, the estimation can be implemented only when a suitable intake vacuum develops in the intake passage. Also, during purging of the canister incoming gas, the fuel injection quantity needs to be reduced so as to cancel an amount of fuel vapor purged into the intake passage, so as to avoid fluctuations in the air/fuel ratio. Accordingly, the fuel concentration in the canister incoming gas can be estimated only in the case where the fuel injection quantity after being reduced as described above is still larger than the controllable minimum fuel injection quantity of the fuel injection valve 156. For these reasons, it is determined in step 200 as exemplary conditions for estimating the fuel concentration whether a suitable intake vacuum develops in the intake passage, and whether the fuel injection quantity measured after reduction is equal to or larger than the minimum fuel injection quantity.

In the case where the internal combustion engine has a function of performing a selected one of stratified charge combustion and uniform charge combustion, purging of canister incoming gas during execution of stratified charge combustion may give rise to a situation where a fuel charge consisting of two layers fails to be formed in the cylinder, and intended combustion performance cannot be achieved. With regard to this type of internal combustion engine, it is appropriate to include a condition that "the engine is in an operating mode of uniform charge combustion" in the conditions for estimation to be determined in step 200.

The above-described step 200 is repeatedly executed until the conditions for estimating the fuel concentration in the canister incoming gas are satisfied. If the conditions are satisfied, the control valve 152 is opened in step 202.

Next, it is determined in step 204 whether a settle-down period of the air/fuel ratio has passed. When the control valve 152 is opened in step 202, the canister incoming gas starts being purged into the intake passage of the internal combustion engine at a flow rate that depends upon the flow resistance of the low-concentration gas purge passage 150 and the magnitude of the intake vacuum. Once the canister incoming gas starts being purged, the air/fuel ratio feedback factor FAF starts being updated so as to reduce a deviation of the air/fuel ratio from the target value. As a suitable period of time passes, the feedback factor FAF is updated to a value that cancels an influence of purge. The above-indicated settle-down period is the time required for FAF to be settled down to an appropriate value in this manner. If it is determined in step 204 that the settle-down period has not passed, there is a possibility that the influence of purge is not completely reflected by the feedback factor FAF. If it is determined in step 204 that the settle-down period has passed, on the other hand, it can be judged that the influence of purge is completely reflected by the feedback factor FAF.

In the routine shown in FIG. 12, step 204 is repeatedly executed until it is determined that the settle-down period has passed. If it is determined that the settle-down period has passed, an amount of change that appears in a certain characteristic value of the air/fuel ratio after start of purge, more specifically, an amount of change ΔFAF of the air/fuel ratio feedback factor FAF, is detected in step 206.

The amount of change ΔFAF that appears after start of purge has a relationship with the amount of fuel vapor supplied to the engine by purging, as described above. In the present embodiment, the ECU 154 is able to estimate the fuel concentration in the canister incoming gas, based on the change of amount ΔFAF. In the routine shown in FIG. 12, step 206 is followed by step 208 in which the fuel concentration in the canister incoming gas is estimated.

As explained above, according to the routine shown in FIG. 12, the fuel concentration in the low-concentration canister incoming gas produced in the middle-concentration gas separation unit 44 can be estimated with high accuracy, based on ΔFAF that is correlated with the fuel concentration. It is to be noted that the internal combustion engine is originally provided with the exhaust $O_2$ sensor for detecting the exhaust air/fuel ratio that provides basic data for calculating the air/fuel ratio feedback factor FAF. Thus, the system of the present embodiment is able to easily and highly accurately estimate the fuel concentration in the canister incoming gas, without significantly increasing the cost of manufacture of the system.

While the sensor disposed in the exhaust passage is in the form of the exhaust $O_2$ sensor 164 (i.e., sensor for determining whether exhaust gas is fuel-rich or fuel-lean), the invention is not limited to this arrangement. For example, the sensor disposed in the exhaust passage may be an exhaust air/fuel ratio sensor adapted to generate an output signal indicative of the value of the exhaust air/fuel ratio.

In the seventh embodiment, the air/fuel ratio feedback control is executed during purging of the canister incoming gas, and the fuel concentration in the canister incoming gas is estimated based on the amount of change ΔFAF of the air/fuel ratio feedback factor FAF that occurs during the feedback control. However, the estimating method is not limited to this method. For example, where an exhaust air/fuel ratio sensor is used, an amount of change ΔFAF of the exhaust air/fuel ratio caused by an influence of purging can be directly measured if the purging operation is carried out while the air/fuel ratio feedback control is not executed. In this case, the fuel concentration in the canister incoming gas may be estimated based on the amount of change ΔA/F since this value ΔA/F is correlated with the fuel concentration in the canister incoming gas.

While it is assumed in the seventh embodiment as described above that no fuel concentration sensor is disposed in the intake passage of the internal combustion engine, the invention is not limited to this arrangement. If the intake passage of the internal combustion engine is provided with a fuel concentration sensor (such as an air/fuel ratio sensor or a HC sensor) for detecting the fuel concentration in gas flowing through the intake passage, the fuel concentration in the canister incoming gas purged into the engine may be estimated (or calculated) based on the air/fuel ratio (or fuel concentration) in the intake passage which is detected by the fuel concentration sensor.

Judgment of Conditions of Separation Films

As described above, the system of the seventh embodiment includes the concentration sensor 61 for detecting the fuel concentration in the processed gas produced by the high-concentration gas separation unit 34. Thus, the system of this embodiment is able to estimate the fuel concentration in the canister incoming gas flowing out of the middle-concentration gas separation unit 44, and is also able to actually measure the fuel concentration in the processed gas produced by the high-concentration gas separation unit 34.

When the system operates normally, a certain relationship is recognized between the fuel concentration in the canister incoming gas and the fuel concentration in the processed gas. If any abnormality occurs in the system, in particular, if any abnormality, such as deterioration or tear of the first separation film 36 or the second separation film 46, occurs, the above-indicated relationship may deviate from an appropriate one. Thus, the system of this embodiment is able to determine the conditions of the first separation film 36 and the second separation film 46 with high accuracy, by determining whether an appropriate relationship is established between the estimated value of the fuel concentration in the canister incoming gas and the actual measurement value of the fuel concentration in the processed gas.

Figure 13:
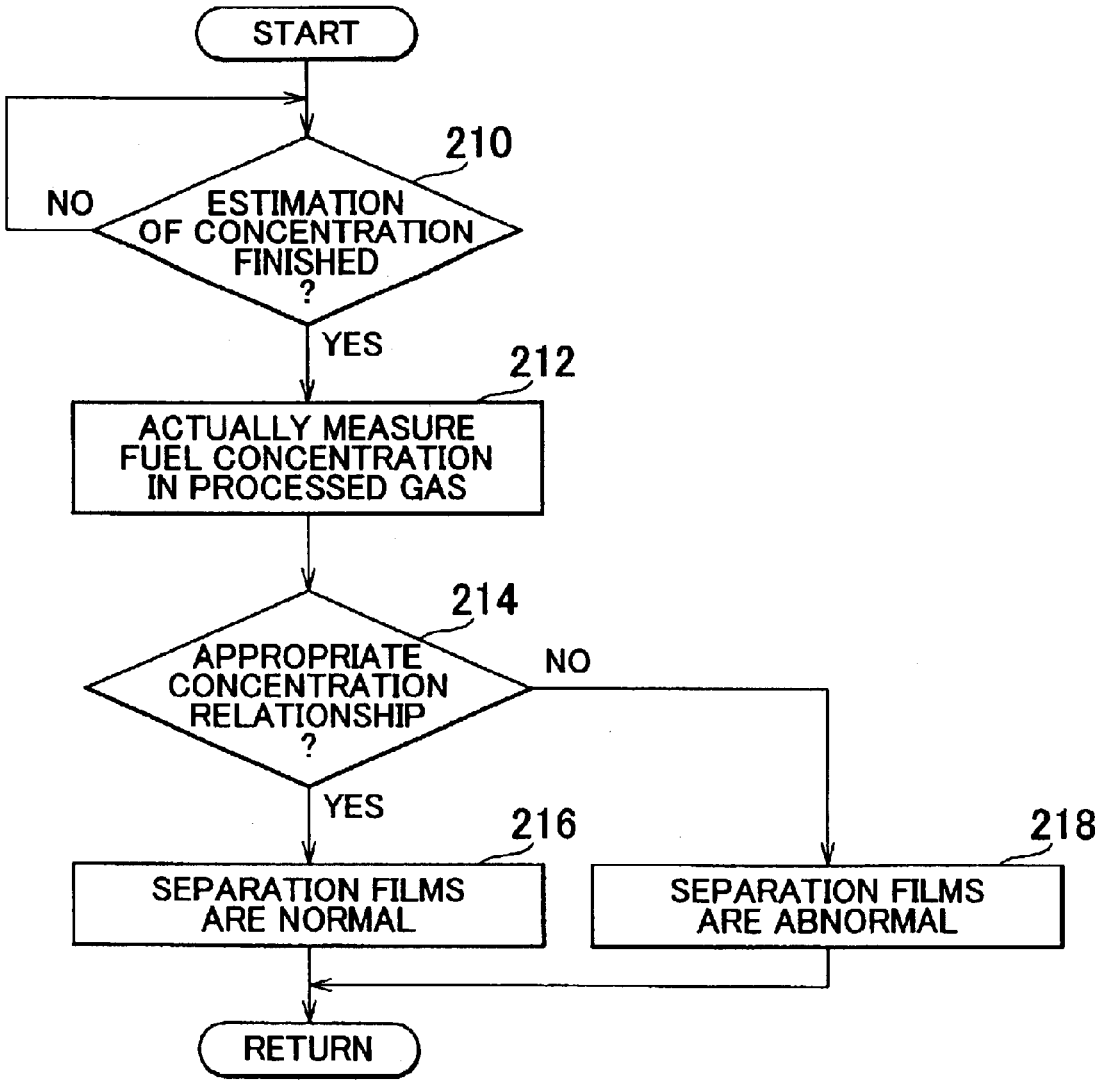
FIG. 13 is a flowchart of a control routine executed for judging conditions of separation films in the system of the seventh embodiment.

FIG. 13 is a flowchart of a control routine executed by the ECU 154 for realizing the above-described function.

In the routine shown in FIG. 13, step 210 is initially executed to determine whether estimation of the fuel concentration in the canister incoming gas has already been finished. This step 210 is repeatedly executed until it is determined that estimation of the fuel concentration is finished. If this condition is satisfied, the fuel concentration in the processed gas is actually measured in step 212, based on an output signal of the concentration sensor 61.

In the routine shown in FIG. 13, it is then determined in step 214 whether an appropriate relationship is established between the fuel concentration in the canister incoming gas estimated according to the routine shown in FIG. 12 and the fuel concentration in the processed gas actually measured in the above step 212.

More specifically, it is determined whether a difference in the fuel concentration falls within an appropriate range that indicates that both of the first separation film 36 and the second separation film 46 are normal. The ECU 154 stores a judgment value (fixed value) used for determining whether the above difference is appropriate, or a map that defines a relationship between the judgment value and the fuel concentration in the processed gas (or the fuel concentration in the canister incoming gas). In step 214, it is determined whether an appropriate relationship is established between the fuel concentration in the canister incoming gas and the fuel concentration in the processed gas, based on the above-indicated fixed value or the judgment value read from the above-described map.

In the routine shown in FIG. 13, when it is determined in step 214 that the relationship between the two concentrations is appropriate, it is determined in step 216 whether the separation films, namely, the first separation film 36 and the second separation film 46, are normal.

If it is determined in the above step 214 that the relationship between the two concentrations is not appropriate, it is determined in step 218 that the separation films are not normal, namely, at least one of the first separation film 36 and the second separation film 46 suffers from an abnormality, such as deterioration or tear or breakage.

As explained above, according to the routine shown in FIG. 13, it is determined with high accuracy whether any abnormality occurs in one or both of the first separation film 36 and the second separation film 46, based on the fuel concentration in the canister incoming gas estimated based on the amount of change ΔFAF and the fuel concentration in the processed gas actually measured by the concentration sensor 61. Thus, the system of this embodiment is able to immediately detect an abnormality in the separation films 36, 46.

In the evaporative fuel emission control system of the seventh embodiment, the low-concentration gas flowing from the middle-concentration gas separation unit 44, namely, canister incoming gas used for purging fuel vapor in the canister 20, is drawn into the intake passage of the internal combustion engine. When the canister incoming gas is drawn into the intake passage, a shortage of the canister incoming gas in comparison with the canister outgoing gas is increased, and a large amount of air flows into the canister through the negative-pressure prevention valve 58.

In order to efficiently release fuel vapor adsorbed in the canister 20, it is desirable that gas flowing into the canister 20 has a low concentration of fuel. If the amount of canister incoming gas is reduced, and the amount of the ambient air flowing into the canister 20 is increased, the fuel concentration in the gas flowing through the canister 20 is further reduced. With the system of this embodiment, therefore, a large amount of fuel vapor in the canister 20 can be released while the canister incoming gas is purged into the intake passage of the engine, thus assuring excellent purging performance.

In the seventh embodiment as described above, the conditions of the first separation film 36 and the second separation film 46 are judged by comparing the fuel concentration in the canister incoming gas that is estimated based on the amount of change ΔFAF with the fuel concentration in the processed gas that is actually measured by the concentration sensor 61. However, the method of judgment is not limited to this method. For example, when both of the first separation film 36 and the second separation film 46 deteriorate, the canister incoming gas may have an excessively high concentration of fuel. In this case, the abnormalities of these films 36, 46 can be detected based solely on the fuel concentration estimated based on ΔFAF, without comparing the two concentrations as described above. Thus, the conditions of the first and second separation films 36 and 46 may be determined based solely on the fuel concentration estimated based on ΔFAF.

While the fuel concentration in the processed gas is actually measured, and the fuel concentration in the canister incoming gas is estimated in the above-described seventh embodiment, the method of determining the conditions of the first and second separation films 36 and 46 is not limited to this method. For example, this determination may be made based on the fuel concentrations in the processed gas and the canister incoming gas which are both actually measured by concentration sensors. In another example, the determination may be made based on the estimated fuel concentration in the processed gas and the actually measured fuel concentration in the canister incoming gas. In a further example, a switching valve may be provided for drawing a selected one of the processed gas and the canister incoming gas to the low-concentration gas purge passage 150, and the above determination may be made based on the fuel concentrations in the processed gas and the canister incoming gas, which concentrations are both estimated.

In the seventh embodiment as described above, the fuel concentration in the second chamber 40 of the high-concentration gas separation unit 34 (i.e., fuel concentration in the processed gas) and the fuel concentration in the gas flowing through the canister incoming gas passage 54 are acquired in order to determine the conditions of both of the first separation film 36 and the second separation film 46. However, the invention is not limited to this method. For example, the fuel concentration in the first chamber 38 of the high-concentration gas separation unit 34 and the fuel concentration in the second chamber 40 of the same unit 34 may be acquired for determining the condition of only the first separation film 36. In another example, the fuel concentration in the first chamber 48 of the middle-concentration gas separation unit 44 and the fuel concentration in the second chamber 50 of the same unit 44 may be acquired for determining the condition of only the second separation film 46. In a further example, the fuel concentration in the first chamber 38 of the high-concentration gas separation unit 34 (or fuel concentration in the first chamber 48 of the middle-concentration gas separation unit 44), the fuel concentration in the second chamber 40 of the high-concentration gas separation unit 34, and the fuel concentration in the second chamber 50 of the middle-concentration gas separation unit 44 may be acquired for determining the condition of the first separation film 36 and the condition of the second separation film 46 independently of each other.

In the seventh embodiment as described above, gas (i.e., canister incoming gas) for which the fuel concentration is to be estimated is purged into the intake passage of the internal combustion engine for the sole purpose of estimating the fuel concentration. However, the invention is not limited to this arrangement. For example, the gas for which the fuel concentration is to be estimated may be purged into the intake passage for the purpose of processing or treatment of fuel vapor when the engine is operating in a state suitable for purging of fuel vapor, in addition to the case where the fuel concentration in the gas should be estimated.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. An evaporative fuel emission control system for an internal combustion engine, comprising:

a canister that adsorbs fuel vapor generated in a fuel tank;

a canister outgoing gas producing unit that causes a canister outgoing gas to flow out of the canister;

a vapor condensing unit that condenses the canister outgoing gas to provide a processed gas containing a higher concentration of fuel vapor than that of the canister outgoing gas;

a processed gas passage through which the processed gas is fed to the fuel tank; and a controller that restricts flow of the processed gas into the fuel tank when the fuel vapor concentration in the processed gas is lower than or is expected to be lower than a predetermined level.

2. The evaporative fuel emission control system according to claim 1, wherein the controller comprises a processed gas circulating unit that guides the processed gas to an upstream side of the vapor condensing unit when the fuel vapor concentration in the processed gas is lower than or is expected to be lower than the predetermined level.

3. The evaporative fuel emission control system according to claim 2, wherein the controller comprises:

a concentration characteristic value detector that detects a characteristic value indicative of the fuel vapor concentration in the processed gas; and a first restricting unit that restricts flow of the processed gas into the fuel tank when it is determined based on the characteristic value that the fuel vapor concentration in the processed gas is lower than the predetermined level.

4. The evaporative fuel emission control system according to claim 1, wherein the controller comprises a second restricting unit that restricts flow of the processed gas into the fuel tank for a predetermined period of time measured from a point of time when the canister outgoing gas starts flowing out of the canister.

5. The evaporative fuel emission control system according to claim 1, wherein the controller comprises:

a concentration characteristic value detector that detects a characteristic value indicative of the fuel vapor concentration in the processed gas; and a first restricting unit that restricts flow of the processed gas into the fuel tank when it is determined based on the characteristic value that the fuel vapor concentration in the processed gas is lower than the predetermined level.

6. The evaporative fuel emission control system according to claim 5, wherein the controller further comprises:

a low-concentration period counter that counts a low-concentration period in which the fuel vapor concentration in the processed gas is lower than the predetermined level, based on the characteristic value; and a first purge stopping unit that stops the canister outgoing gas producing unit so as to stop flow of the canister outgoing gas from the canister when the low-concentration period reaches a predetermined stop judgment period.

7. The evaporative fuel emission control system according to claim 5, further comprising:

a concentration changing tendency detector that detects a tendency of a change of the fuel vapor concentration in the processed gas when it is determined based on the characteristic value that the fuel vapor concentration in the processed gas is lower than the predetermined value; and a second purge stopping unit that stops the canister outgoing gas producing unit so as to stop flow of the canister outgoing gas from the canister when the fuel vapor concentration in the processed gas has a tendency of decreasing or a tendency of being maintained at substantially the same level.

8. The evaporative fuel emission control system according to claim 6, further comprising:

a concentration changing tendency detector that detects a tendency of a change of the fuel vapor concentration in the processed gas when it is determined based on the characteristic value that the fuel vapor concentration in the processed gas is lower than the predetermined value; and a second purge stopping unit that stops the canister outgoing gas producing unit so as to stop flow of the canister outgoing gas from the canister when the fuel vapor concentration in the processed gas has a tendency of decreasing or a tendency of being maintained at substantially the same level.

9. The evaporative fuel emission control system according to claim 8, further comprising:

an elapsed time counter that counts a period of time that elapses after stop of the canister outgoing gas producing unit; and a first purge re-starting unit that starts the canister outgoing gas producing unit when the elapsed time after the stop reaches a predetermined re-start judgment period.

10. The evaporative fuel emission control system according to claim 9, further comprising:

a fuel vapor generation estimating unit that estimates a state of generation of fuel vapor in the fuel tank; and a re-start judgment period setting unit that sets the re-start judgment period based on the state of generation of the fuel vapor.

11. The evaporative fuel emission control system according to claim 10, wherein the fuel vapor generation estimating unit comprises at least one of an atmosphere temperature detector that detects a temperature of an atmosphere, and an engine state detector that detects an operating state of the internal combustion engine.

12. The evaporative fuel emission control system according to claim 8, further comprising:

a refueling detector that detects refueling of the fuel tank; and a second purge re-starting unit that re-starts the canister outgoing gas producing unit when refueling is detected during stop of the canister outgoing gas producing unit.

13. The evaporative fuel emission control system according to claim 6, further comprising:

an elapsed time counter that counts a period of time that elapses after stop of the canister outgoing gas producing unit; and a first purge re-starting unit that re-starts the canister outgoing gas producing unit when the elapsed time after the stop reaches a predetermined re-start judgment period.

14. The evaporative fuel emission control system according to claim 13, further comprising:

a fuel vapor generation estimating unit that estimates a state of generation of fuel vapor in the fuel tank; and a re-start judgment period setting unit that sets the re-start judgment period based on the state of generation of the fuel vapor.

15. The evaporative fuel emission control system according to claim 14, wherein the fuel vapor generation estimating unit comprises at least one of an atmosphere temperature detector that detects a temperature of an atmosphere, and an engine state detector that detects an operating state of an internal combustion engine.

16. The evaporative fuel emission control system according to claim 6, further comprising:

a refueling detector that detects refueling of the fuel tank; and a second purge re-starting unit that re-starts the canister outgoing gas producing unit when refueling is detected during stop of the canister outgoing gas producing unit.

17. The evaporative fuel emission control system according to claim 1, further comprising:

an intake vacuum control valve having an open state in which a system including the canister, the fuel tank and the vapor condensing unit with an intake passage of the internal combustion engine, and a closed state in which the system is shut off from the intake passage;

a vacuum introducing unit that introduces an intake vacuum into the system via the intake vacuum control valve;

a pressure detector that detects a pressure within the system; and a first leak detector that detects a leak in the system, based on a change in the pressure within the system that follows the introduction of the intake vacuum into the system.

18. The evaporative fuel emission control system according to claim 1, wherein the canister outgoing gas producing unit comprises a purge pump that receives a gas from a selected one of the canister and an atmosphere and delivers the gas, the control system further comprising:

a system pressurizing unit that increases a pressure within a system including the canister, the fuel tank and the vapor condensing unit, by causing the purge pump to deliver the gas drawn from the atmosphere;

a pressure detector that detects the pressure within the system; and a second leak detector that detects a leak in the system, based on a change in the pressure within the system that follows the pressurization of the system.

19. An evaporative fuel emission control system for an internal combustion engine, comprising:

a canister that adsorbs fuel vapor generated in a fuel tank;

a canister outgoing gas producing unit that causes a canister outgoing gas to flow out of the canister;

a vapor condensing unit that condenses the canister outgoing gas to provide a processed gas containing a higher concentration of fuel vapor than that of the canister outgoing gas;

a processed gas passage through which the processed gas is fed to the fuel tank;

a bypass passage that allows communication of an upstream side of the vapor condensing unit with the fuel tank;

a switching valve having an open state in which the bypass passage communicates the upstream side of the vapor condensing unit with the fuel tank, and a closed state in which the bypass passage is shut off; and a switching valve controller that controls the switching valve such that the switching valve is placed in the open state during stop of the canister outgoing gas producing unit, and is placed in the closed state during an operation of the canister outgoing gas producing unit.

20. The evaporative fuel emission control system according to claim 1, wherein the vapor condensing unit comprises a separation film that separates the canister outgoing gas that flows out of the canister, into a high-concentration processed gas containing a high concentration of fuel vapor, and a low-concentration processed gas containing a low concentration of fuel vapor, the evaporative fuel emission control system further comprising:

a first gas supply unit that supplies one of the high-concentration processed gas and the low-concentration processed gas to an intake system of the internal combustion engine;

an air/fuel ratio characteristic value detector that detects, as an air/fuel ratio characteristic value, at least one of a fuel concentration in an intake gas flowing through an intake passage of the engine, an air/fuel ratio of an air-fuel mixture supplied to the engine for combustion, and a correction factor with which a fuel injection quantity is corrected for maintaining the air/fuel ratio at a desired value;

a first concentration estimating unit that estimates a fuel concentration in said one of the high-concentration processed gas and the low-concentration processed gas as a first concentration, based on the air/fuel ratio characteristic value detected during supply of said one gas into the intake system; and a separation film condition determining unit that determines a condition of the separation film based on the estimated value of the fuel concentration as the first concentration.

21. The evaporative fuel emission control system according to claim 20, further comprising a second concentration acquiring unit that acquires a fuel concentration in the other of the high-concentration processed gas and the low-concentration processed gas, as a second concentration, wherein the separation film condition determining unit determines the condition of the separation film based on the first concentration and the second concentration.

22. The evaporative fuel emission control system according to claim 21, wherein the second concentration acquiring unit includes a second concentration detector that detects the fuel concentration in the other gas.

23. The evaporative fuel emission control system according to claim 21, wherein the second concentration acquiring unit comprises:

a second gas supply unit that supplies the other gas to the intake system under a condition that said one gas is not supplied to the intake system; and a second concentration estimating unit that estimates the fuel concentration in the other gas as the second concentration, based on the air-fuel ratio characteristic value detected during supply of the other gas to the intake system.

24. The evaporative fuel emission control system according to claim 20, further comprising:

a canister incoming gas passage through which the low-concentration processed gas is returned to the canister as a gas for purging fuel vapor stored in the canister; and an air supply unit that causes air to flow into the canister by an amount corresponding to a difference in amount between the canister outgoing gas and the canister incoming gas, wherein said one of the low-concentration processed gas and the high-concentration processed gas is the low-concentration processed gas.

* * * * *